US007350587B2

(12) United States Patent
Springett et al.

(10) Patent No.: US 7,350,587 B2
(45) Date of Patent: Apr. 1, 2008

(54) PIPE GUIDE

(75) Inventors: Frank Benjamin Springett, Houston, TX (US); Eric T. Ensley, Cypress, TX (US); Dean A. Bennett, Katy, TX (US); James D. Brugman, Spring, TX (US)

(73) Assignee: Varco I/P, Inc., Houston, TX (US)

( * ) Notice: Subject to any disclaimer, the term of this patent is extended or adjusted under 35 U.S.C. 154(b) by 284 days.

(21) Appl. No.: 11/176,694

(22) Filed: Jul. 7, 2005

(65) Prior Publication Data

US 2006/0113075 A1 Jun. 1, 2006

Related U.S. Application Data

(60) Provisional application No. 60/631,954, filed on Nov. 30, 2004.

(51) Int. Cl.
*E21B 19/16* (2006.01)

(52) U.S. Cl. ..... 166/380; 166/77.52

(58) Field of Classification Search ..... 166/77.14, 166/77.51, 77.52, 380; 81/57.16; 212/347; 175/85

See application file for complete search history.

(56) References Cited

U.S. PATENT DOCUMENTS

| | | | | |
|---|---|---|---|---|
| 3,883,009 | A * | 5/1975 | Swoboda et al. | 414/740 |
| 4,069,879 | A | 1/1978 | Brown | 175/57 |
| 4,162,873 | A * | 7/1979 | Smith, Jr. | 414/718 |
| 4,182,424 | A | 1/1980 | Prebensen | 175/211 |
| 4,306,339 | A | 12/1981 | Ward | 24/263 |
| 4,492,136 | A * | 1/1985 | Walker | 83/169 |
| 4,518,309 | A | 5/1985 | Brown | 414/745 |
| 4,625,796 | A | 12/1986 | Boyadjieff | 166/77.5 |
| 4,684,314 | A | 8/1987 | Luth | 414/745 |
| 4,951,759 | A | 8/1990 | Richardson | 175/85 |
| 5,595,248 | A | 1/1997 | Denny | 168/379 |
| 5,988,299 | A | 11/1999 | Hansen et al. | 175/52 |
| 6,056,478 | A * | 5/2000 | Martin et al. | 405/168.3 |
| 6,536,520 | B1 | 3/2003 | Snider et al. | 166/78.1 |
| 6,739,397 | B2 | 5/2004 | Ayling | 166/380 |
| 6,742,584 | B1 | 6/2004 | Appleton | 166/98 |
| 6,854,520 | B1 | 2/2005 | Robichaux | 166/380 |

(Continued)

FOREIGN PATENT DOCUMENTS

| | | |
|---|---|---|
| EP | O387017 | 7/1990 |

(Continued)

OTHER PUBLICATIONS

Continuous Circulation Systems. Shaffer—A Varco Company. 2 pp., 2003.

(Continued)

*Primary Examiner*—David Bagnell
*Assistant Examiner*—Daniel P Stephenson
(74) *Attorney, Agent, or Firm*—Guy McClung

(57) ABSTRACT

A guide is disclosed for facilitating the movement of tubulars in well operations. In one aspect, the guide is a pipe guide with a base, an upper extension apparatus, a lower extension apparatus with a first end pivotably secured to the upper extension apparatus and selectively extendable with the upper extension apparatus, and a pipe holder apparatus connected to the upper extension apparatus.

20 Claims, 36 Drawing Sheets

U.S. PATENT DOCUMENTS

| | | | | |
|---|---|---|---|---|
| 7,188,547 | B1 * | 3/2007 | West et al. | 81/57.16 |
| 2003/0221519 | A1 | 12/2003 | Haugen | 81/57.15 |
| 2004/0154835 | A1 | 8/2004 | Allen et al. | 175/170 |

FOREIGN PATENT DOCUMENTS

| | | |
|---|---|---|
| WO | WO 98/16716 | 10/1997 |

OTHER PUBLICATIONS

CCS Circulating System. Shafter—A Varco Comopany. 3 pp., Aug. 2002.

Written Opinion; PCT/GB2005/050195; 7 pages; Jan. 20, 2006.

Int'l Search Report; PCT/GB2005/050195; 4 pages; Jan. 20, 2006.

* cited by examiner 104
152
156b
152
156
156b
160
156a
110
131
131
106
131a
131a

PIPE GUIDE

RELATED APPLICATION

This is a continuation-in-part of U.S. Application Ser. No. 60/631,954 filed Nov. 30, 2004 which is incorporated herein for all purposes and from which the present invention claims priority under the Patent Laws.

BACKGROUND OF THE INVENTION

1. Field of the Invention

This present invention is directed to pipe guides, methods of their use, and top drive systems for wellbore operations with such a pipe guide.

2. Description of Related Art

The prior art discloses a wide variety of pipe guides used in wellbore operations, including, but not limited to, those in U.S. Patents.

In several prior art drilling systems, a continuous fluid circulation system is used so that tubulars added to a string, e.g. but not limited to drill pipe added to a drill string, are added without terminating the circulation of fluid through the string and in the wellbore. Typical continuous circulation systems permit the making or breaking of a threaded connection between two tubulars, e.g. a saver-sub-drill-pipe connection in a top drive drilling system, within an enclosed chamber so that drilling fluid is continuously circulated through the string and wellbore.

Certain prior art wellbore drilling operations involve the addition of drill pipes to a drill string that extends down into a wellbore and which is rotated and urged downwardly to drill the wellbore. Typically drilling fluid is circulated through the drill string and back up an annular region formed by the drill string and the surrounding formation to lubricate and cool the bit, and to remove cuttings and debris from the wellbore. In one prior art method a kelly bar, connected to a top joint of the drill string, is used to rotate the drill string. A rotary table at the derrick floor level rotates the kelly bar while simultaneously the kelly bar can move vertically through a drive bushing within the rotary table at the rig floor. In another prior art method, top drive drilling unit suspended in a derrick grips and rotates the drill string and a kelly bar is not used.

Elevators are used in these operations to selectively support tubular members and to facilitate moving tubular members from one location to another.

It is often preferable to maintain drilled cuttings in suspension in the drilling fluid to facilitate moving them away from a drill bit and to prevent them from falling back down in a wellbore. Cessation of fluid circulation can cause the drilled cuttings to sink. To counter this in many prior art systems additional fluid weighting is attempted, often increasing the viscosity of the fluid. This results in the need for more pumping power at the surface to move the thicker fluid; but such an increase in pump force can result in over pressuring of a downhole which can cause formation damage or loss of fluids downhole.

Certain prior art continuous circulation systems are proposed in U.S. Pat. No. 6,412,554 which attempt continuous fluid circulation during the drilling operation, but in these systems rotation of the drill string is stopped and re-started in order to make and break tubular connections. This involves significant loss of drilling time. Also, starting rotation of the drill string can result in damaging over torque portions of the drill string.

United States Published Patent Application No. 0030221519 published Dec. 4, 2003 (U.S. Serial No. 382080, filed: Mar. 5, 2003) discloses an apparatus that permits sections of tubulars to be connected to or disconnected from a string of pipe during a drilling operation. The apparatus further permits the sections of drill pipe to be rotated and to be axially translated during the connection or disconnection process. The apparatus further allows for the continuous circulation of fluid to and through the tubular string during the makeup or breakout process. The apparatus defines a rig assembly comprising a top drive mechanism, a rotary drive mechanism, and a fluid circulating device. Rotation and axial movement of the tubular string is alternately provided by the top drive and the rotary drive. Additionally, continuous fluid flow into the tubular string is provided through the circulation device and alternately through the tubular section once a connection is made between an upper tubular connected to the top drive mechanism and the tubular string. This application also discloses a method for connecting an upper tubular to a top tubular of a tubular string while continuously drilling, the method including steps of: operating a rotary drive to provide rotational and axial movement of the tubular string in the wellbore; positioning the upper tubular above the top tubular of the tubular string, the upper tubular configured to have a bottom threaded end that connects to a top threaded end of the top tubular; changing a relative speed between the upper tubular and the top tubular to threadedly mate the bottom threaded end of the upper tubular and the top threaded end of the top tubular such that the upper tubular becomes a part of the tubular string; releasing the tubular string from engagement with the rotary drive; and operating a top drive to provide rotational and axial movement of the tubular string in the wellbore.

In some prior art systems in which a top drive system is used for drilling, a stand of drill pipe (e.g. a 90 foot stand with three interconnected pieces of drill pipe) is threadedly connected to and below a saver sub. The saver sub is connected to part of a top drive drilling unit and, once drilling has proceeded down to the extent of the length of a stand, the saver sub has entered into and is located within a chamber of a continuous fluid circulation system. In order to add a new stand with this type of prior art system, a connection is broken within a fluid circulating system, the top drive drilling unit is raised and, along with it, the saver sub is raised and exits from the top of the continuous circulation system. In order, then, to connect a new stand of drill pipe, a portion of a top drive drilling unit (e.g. an elevator) is, in some prior art methods, moved away from the wellbore. Typically an elevator is associated with the top drive drilling unit, but this elevator often cannot be used to receive and support the new stand because a saver sub interferes with the operation.

In many cases, as a top drive drilling unit is raised, it is desirable to backream to circulate fluid and rotate the string coming out of the hole (the wellbore) as the top drive drilling unit is raised, e.g. to smooth out the hole and prevent the formation of keyseats.

Another problem with such drilling systems is that it is desirable to drill down as far as possible with each new stand of drill pipe; but items and apparatuses (e.g. elevators) suspended below a top drive drilling unit prevent further downward progress of the top drive drilling unit unless they are moved out of the way away from the wellbore centerline so that the top drive drilling unit can continue to rotate the drill string as the top drive drilling unit's saver sub enters the continuous circulation system (and the top drive approaches the continuous circulation system). Typically, the elevator etc. are moved in one direction away from the wellbore centerline (and prior art elevators that only open to one side are used).

SUMMARY OF THE PRESENT INVENTION

The present invention discloses, in certain aspects, a tubular guide, e.g. a guide for pipe or for other tubulars, having: a base; upper extension apparatus pivotably secured to the base and selectively extendable from the base; lower extension apparatus having a first end and a second end, the first end pivotably secured to the upper extension apparatus, the lower extension apparatus selectively extendable with the upper extension apparatus; and holder apparatus connected to the upper extension apparatus.

The present invention discloses, in certain aspects, a well system having: a continuous circulation system with a top and a bottom; a pipe guide connected to the top of the continuous circulation system, the pipe guide as any according to the present invention; the pipe guide having a holder apparatus movable toward and away from a center of the continuous circulation system.

The present invention, in at least certain embodiments, teaches a new top drive drilling system with a top drive drilling unit and joint breaking system and an elevator suspended beneath it. In certain aspects, the elevator has dual opposed members which have dual interactive connection apparatuses so that either side of the elevator can be opened. Thus, the elevator can be opened on one side to permit the elevator unit to be moved away from the wellbore center line so that the top drive drilling unit can drill the drill string down as far as possible before adding a new piece or stand of drill pipe; and then the elevator can be opened from the other side for receiving a new piece or stand of drill pipe (and in a backreaming operation according to the present invention the reverse is true).

In certain aspects, such an elevator has dual opposed selectively releasable latch mechanisms and dual opposed handling projections.

It is, therefore, an object of at least certain preferred embodiments of the present invention to provide new, useful, unique, efficient, nonobvious systems and methods, including, but not limited to: tubular guide systems; pipe guides; well systems with such a tubular or pipe guide; top drive drilling systems, components thereof; continuous circulation systems; and methods of the use of all of these things; and Such systems and methods with a pipe guide as disclosed herein according to the present invention; and/or an elevator suspended below a top drive drilling unit, the elevator having dual opposed structures so that either side thereof can be opened, one side being opened permitting movement away from a wellbore centerline for further drill down of a drill string and the other side being opened for receiving a new stand of drill pipe to be added to the drill string (or to accomplish the reverse in a backreaming operation); and Such elevators with dual opposed selectively operable latching mechanisms and with dual opposed handling projections.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
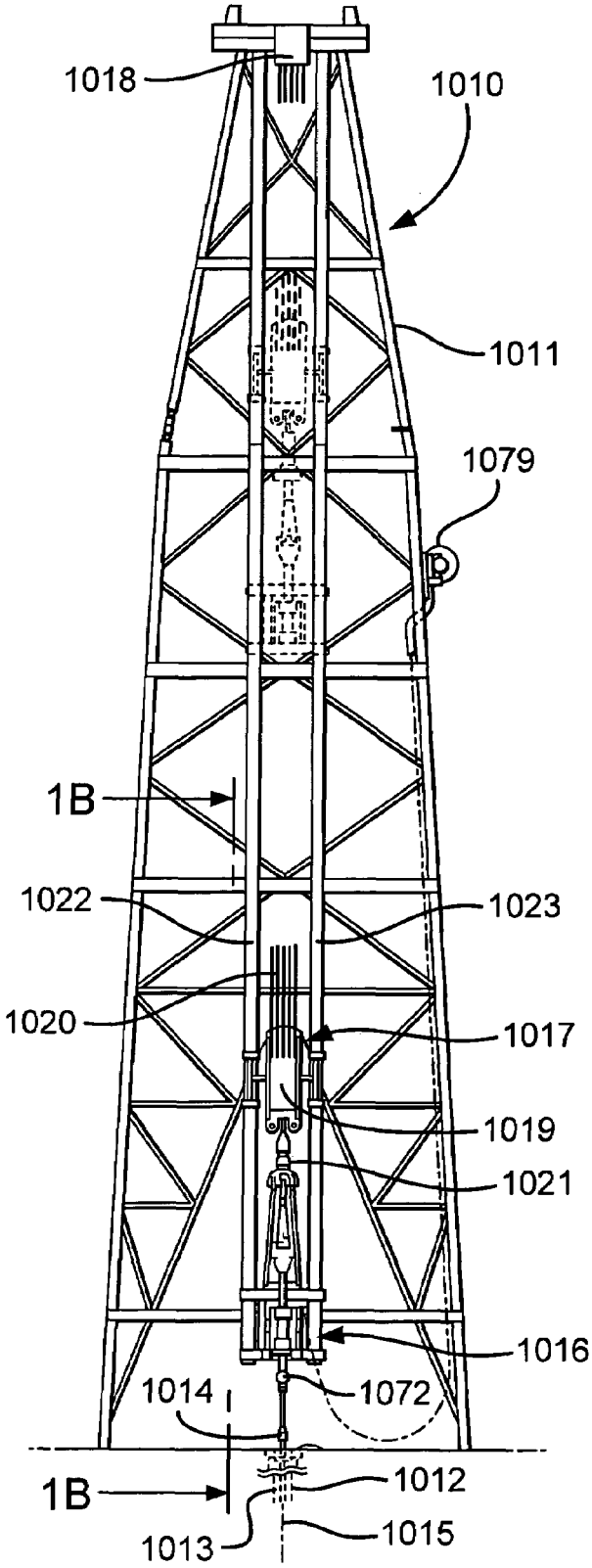
Fig.1A Prior Art
FIG. 1A is a front elevation view of a prior art well drilling apparatus.
Figure 1B:
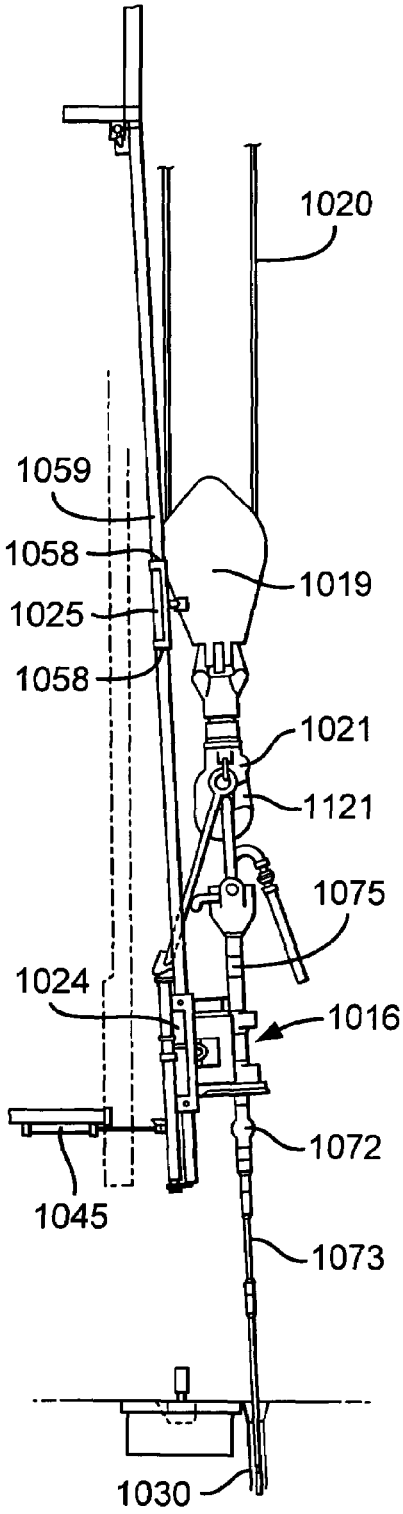
Fig.1B Prior Art
FIG. 1B is a side elevational view taken on line 1B-1B of FIG. 1A but showing the drilling unit swung to its mouse-hole position.
Figure 1C:
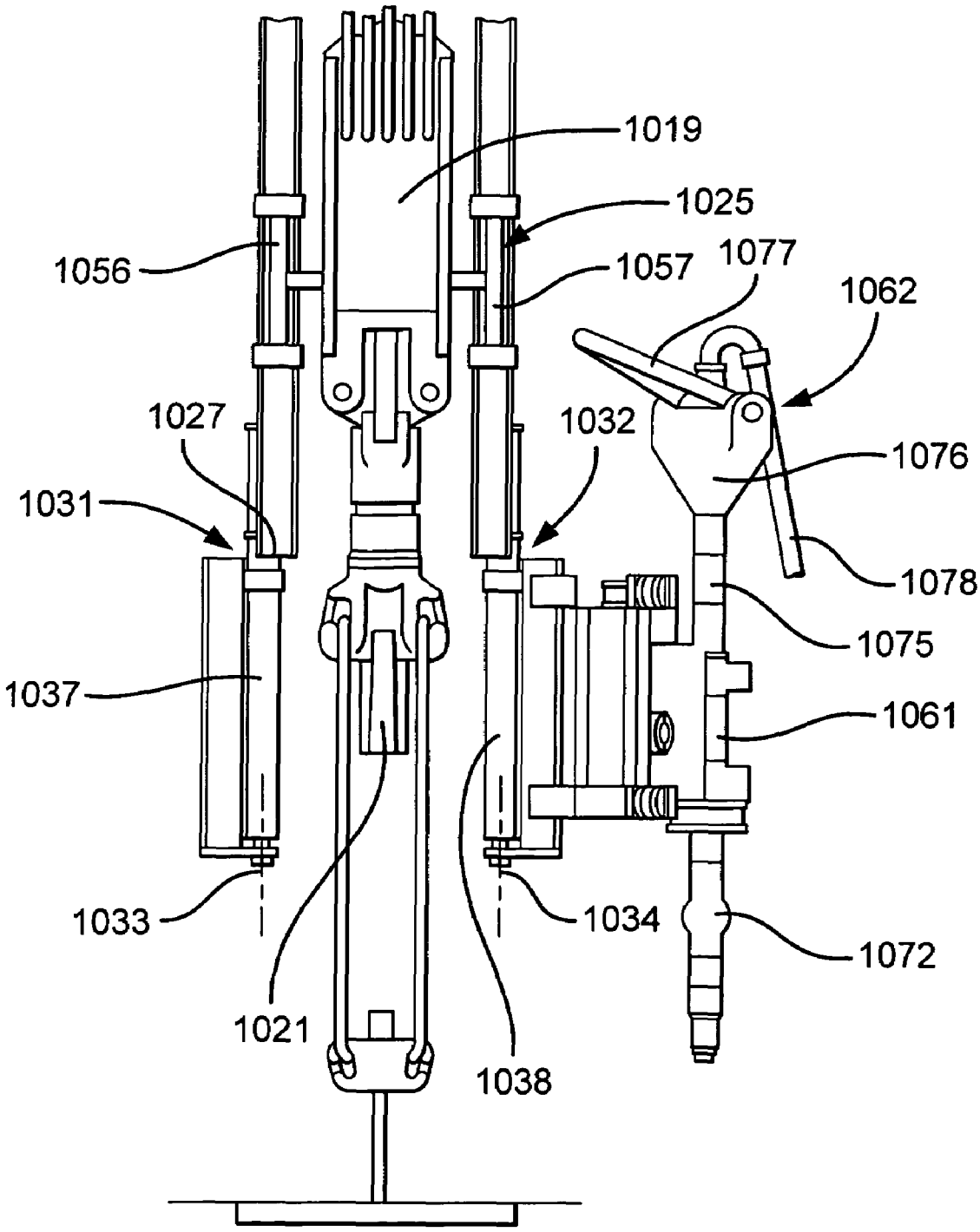
Fig.1C Prior Art
FIG. 1C is a fragmentary front elevational view showing the drilling unit of FIG. 1A swung to its retracted position permitting a trip of the well pipe into or out of the well.

FIGS. 1A-1C show a prior art rig and top drive system 1010 as disclosed in U.S. Pat. No. 4,458,768 (incorporated fully herein for all purposes).

The prior art drilling rig 1010 illustrated in FIGS. 1A-1C includes a derrick 1011 projecting upwardly above a location at which a well bore 1012 is being drilled by a rotary drill string 1013 formed in conventional manner in a series of drill pipe stands connected together in end-to-end fashion at threaded connections 1014. The string 1013 is turned about the vertical axis 1015 of the well by a drilling unit 1016 connected to the upper end of the string. The drill string and unit 1016 are supported and adapted to be moved upwardly and downwardly by a hoisting mechanism 1017 including a crown block 1018, traveling block 1019, tackle 1020, supporting block 1019 from block 1018, and power driven draw works for reeling the line 1020 in or out to raise or lower the traveling block. The traveling block supports a hook 1021 from which the drilling unit is suspended, and which has a gate 1121 adapted to be opened for connecting and disconnecting the drilling unit. The drilling unit 1016 and hook 1019 are guided during their upward and downward movement by two sectionally formed parallel elongated guide rails 1022 and 1023, engaging and guiding a carriage 1024 forming a portion of the drilling unit and a carriage 1025 to which the traveling block is connected.

The two sectionally formed guide rails 1022 and 1023 are preferably of H-shaped horizontal sectional configuration that continues from the upper extremity of each rail to its lower extremity. The rails 1022 and 1023 have upper sections which extend from the upper end of derrick 1011 to a mid-derrick location and are attached rigidly to the derrick for retention stationarily in positions of extension directly vertically and parallel to one another and to well axis 1015. Beneath the mid-derrick location the two guide rails have second portions or sections extending parallel to one another, continuing downwardly and to locations 1027, and mounted by two pivotal connections for swinging movement relative to upper sections and about a horizontal axis. An inclined mousehole 1030 is used (FIG. 1B).

The rails have third lowermost sections which are carried by the second sections for swinging movement therewith between the vertical and inclined positions and which also are mounted by connections 1031 and 1032 for horizontal swinging movement about two axes 1033 and 1034 which are parallel to one another and to the longitudinal axes of the second sections.

The two pivotal connections 1031 and 1032 include two parallel mounting pipes or tubes 1037 and 1038 connected rigidly to the second sections. The two second rail sections are adapted to be power actuated between the vertical and inclined positions by a piston and cylinder mechanism 1045 whose cylinder is connected to a horizontally extending stationary portion of the derrick, and whose piston rod acts against the tube 1037 of pivotal connection 1031.

Carriage 1025 to which traveling block 1019 is connected includes two frames 1056 and 1057 extending partially about the rails 1022 and 1023 respectively and rotatably carrying rollers 1058 which are received between and engage the front and rear flanges 1059 of the various rail sections in a manner effectively locating carriage 1025 against movement transversely of the longitudinal axis of the rail structure, and guiding the carriage for movement only longitudinally of the rails.

The drilling unit 1016 includes the previously mentioned rail contacting carriage structure 1024, a power unit 1061 for turning the string, and a conventional swivel 1062 for delivering drilling fluid to the string.

The power unit 1061 of the drilling assembly includes a pipe section having a lower tapered external thread forming a pin and threadedly connectable to the upper end of drill string 1013 to drive it. In most instances, a conventional crossover sub 1072 and a short "pup joint" 1073 are connected into the string directly beneath the power unit. At its upper end, pipe section 1070 has a tapered internal thread connectable to the rotary stem 1075 of swivel 1062. This stem 1075 turns with the drill string relative to the body 1076 of the swivel, which body is supported in non-rotating relation by a bail 1077 engaging hook 1021 of the traveling block. Drilling fluid is supplied to the swivel through a flexible inlet hose 1078, whose second end is connected to the derrick at an elevated location 1079 well above the level of the rig floor. For driving the tubular shaft 1070, power unit 1061 includes an electric motor.

Figure 2:
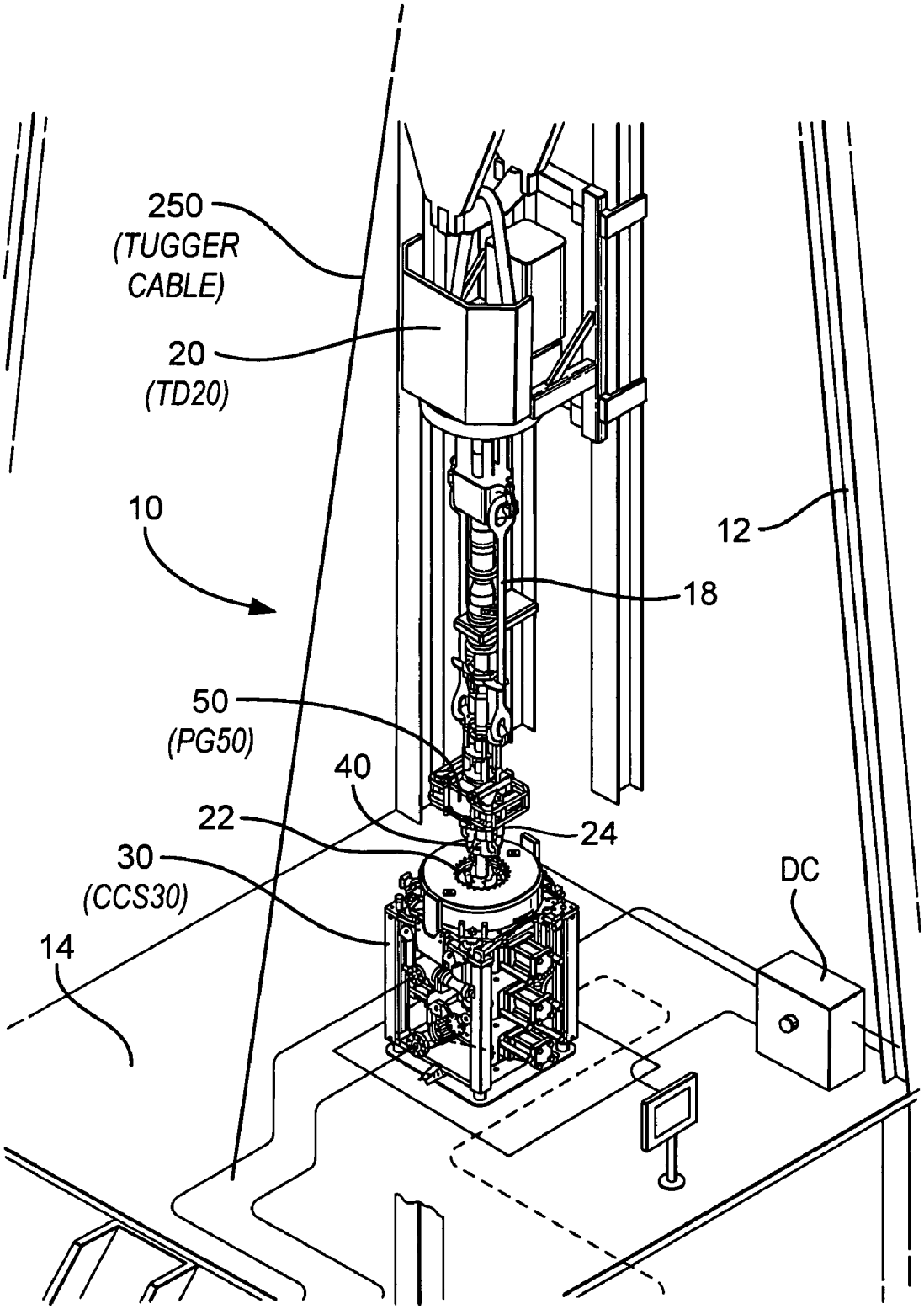
FIG. 2 is a perspective view of a top drive drilling system according to the present invention.

FIG. 2 shows a top drive drilling system 10 according to the present invention which includes a top drive drilling unit 20 ("TD 20") suspended in a derrick 12 (like the rig and derrick in FIG. 1A with the various parts etc. as shown in FIG. 1A). A continuous circulation system 30 ("CCS 30") rests on a rig floor 14 and part of a saver sub 22 projects up from the CCS 30. The saver sub 22 is connected to and rotated by the TD 20.

The CCS 30 is any known continuous circulation system and is, in one aspect, a CCS system commercially available from Varco International, Inc.

An elevator 40 according to the present invention is suspended below the TD 20. Optionally, a pipe gripper 50 ("PG 50") is suspended from the TD 20 and the elevator 40 is suspended from the PG 50. Any suitable known pipe gripper may be used for the pipe gripper 50 or, alternatively, a pipe gripper may be used as disclosed in the co-pending and co-owned U.S. patent application entitled "Pipe Gripper And Top Drive Systems," U.S. Ser. No. 10/999,815 filed Nov. 30, 2004. The PG 50 is suspended from the TD 20 with links 18 and the elevator 40 is suspended from the PG 50 with links 24.

In one embodiment (see FIG. 3) each link 24 has a lower portion 25 which passes through corresponding eyes 45 of the elevator 40 and has a top section 26 with dual spaced-apart tubular portions 27*a*, 27*b* which receive corresponding parts 25*a*, 25*b* of the lower portion 25. Optionally, the links 24 have a top hollow tubular member 28, movable with respect to the PG 50, to which the tubular portions 27*a*, 27*b* are connected.

Figure 3:
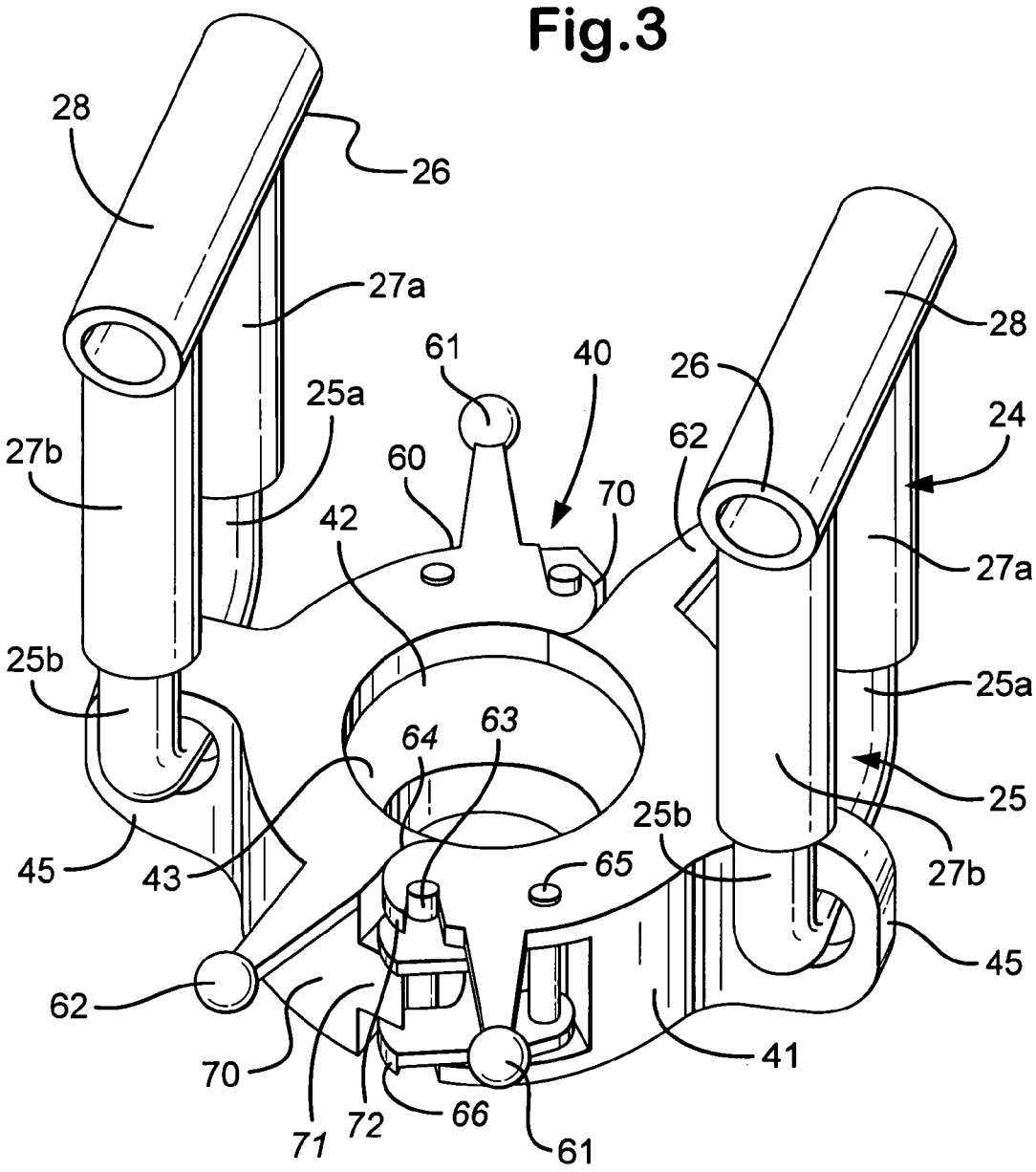
FIG. 3 is a perspective view of an elevator according to the present invention.

The elevator 40 as shown in FIG. 3 has two body members 41, each with an eye 45 which serve as lift points. An interior recess 42 of each body member 41 has a tapered portion 43 against which rests part of a tubular held by the elevator 40. Each body member 41 includes a selectively engageable latching mechanism 60 which cooperates with corresponding latch structure 70 on the other body member 41. Each latching mechanism 60 includes a projecting handle or arm 61. Optionally, each body member 41 includes a second handle or arm 62 to facilitate handling of the elevator 40 and/or operation of the latch mechanisms 60.

Figure 4:
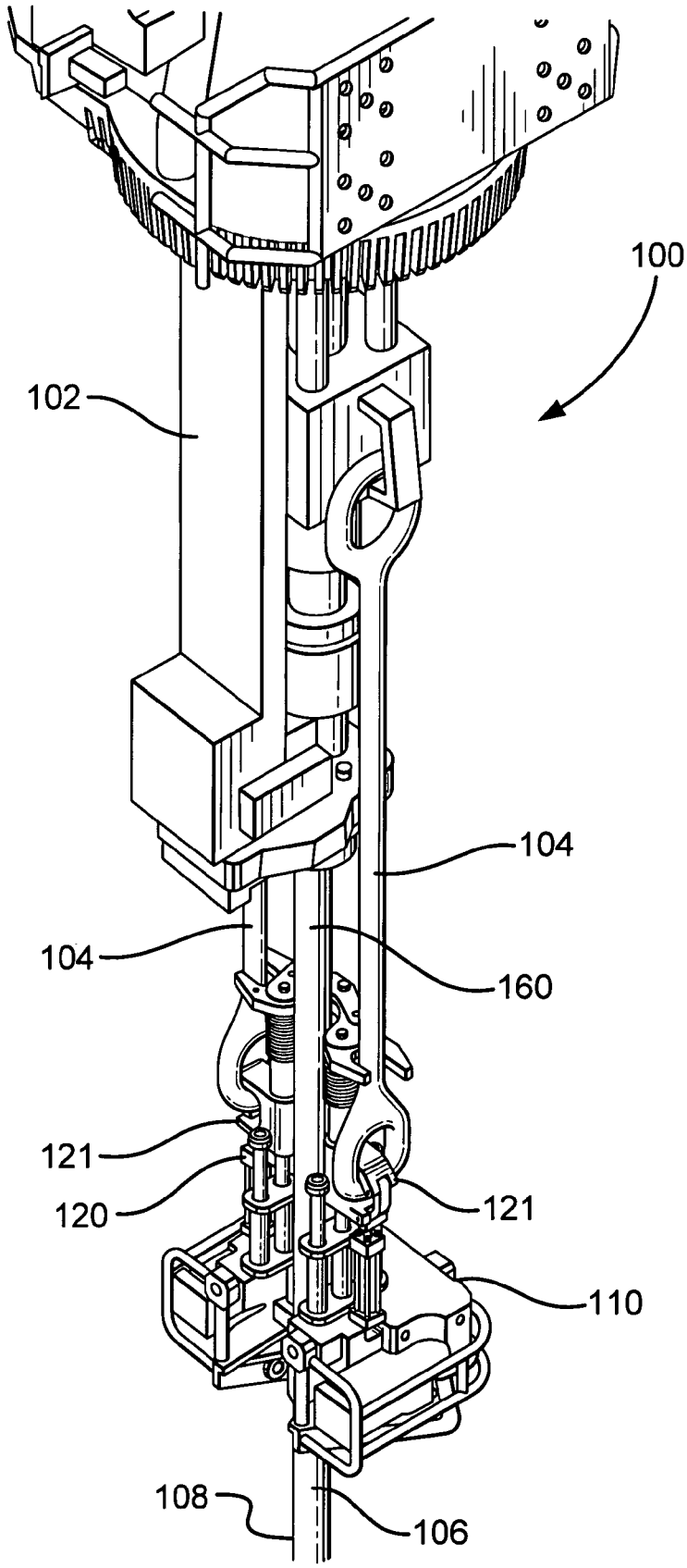
FIG. 4 is a perspective view of a top drive system according to the present invention with a connection tool according to the present invention.
Figure 5A:
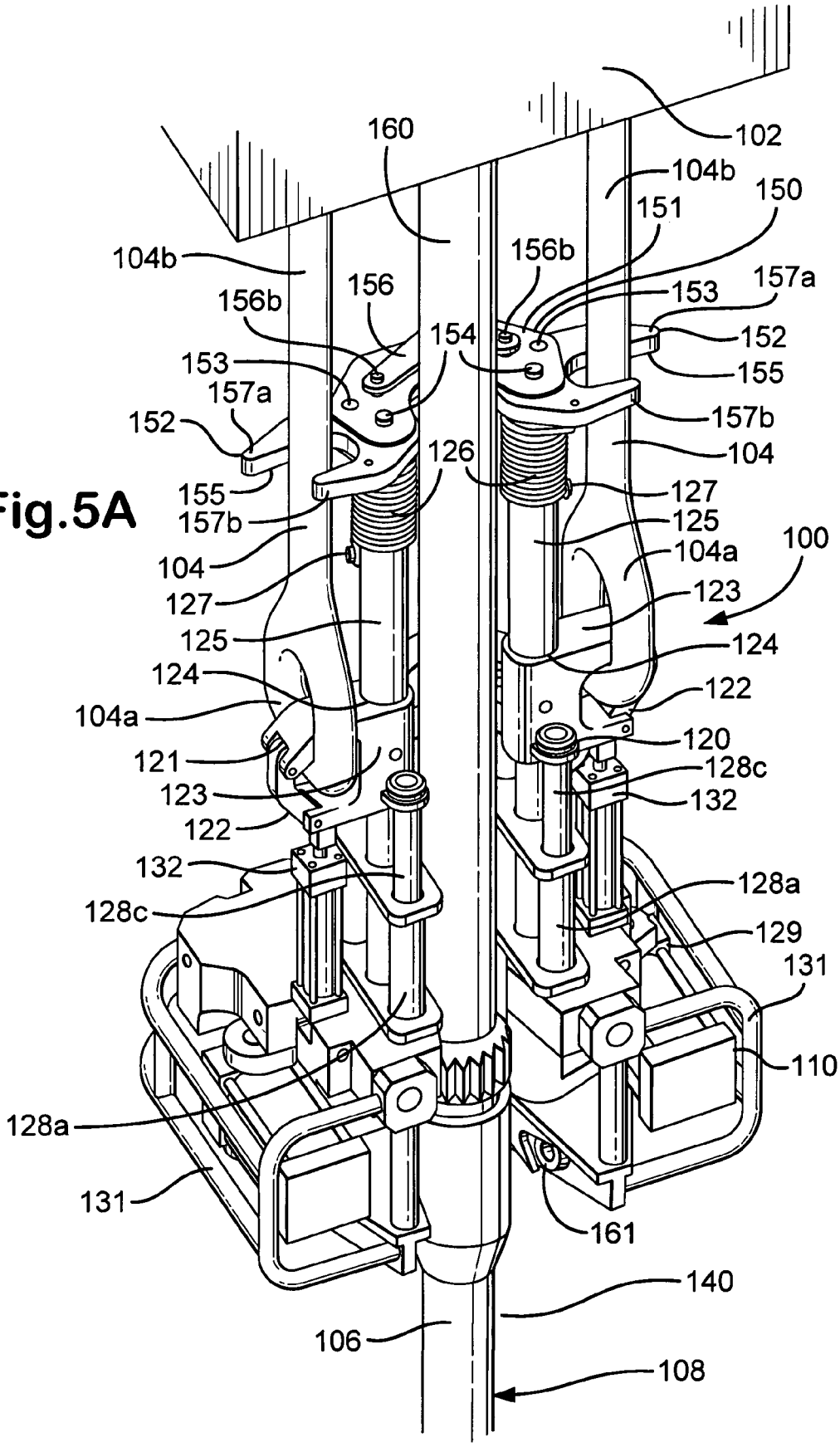
FIGS. 5A, 5B, 5C and 6 are perspective views of a connection tool according to the present invention.
Figure 5B:
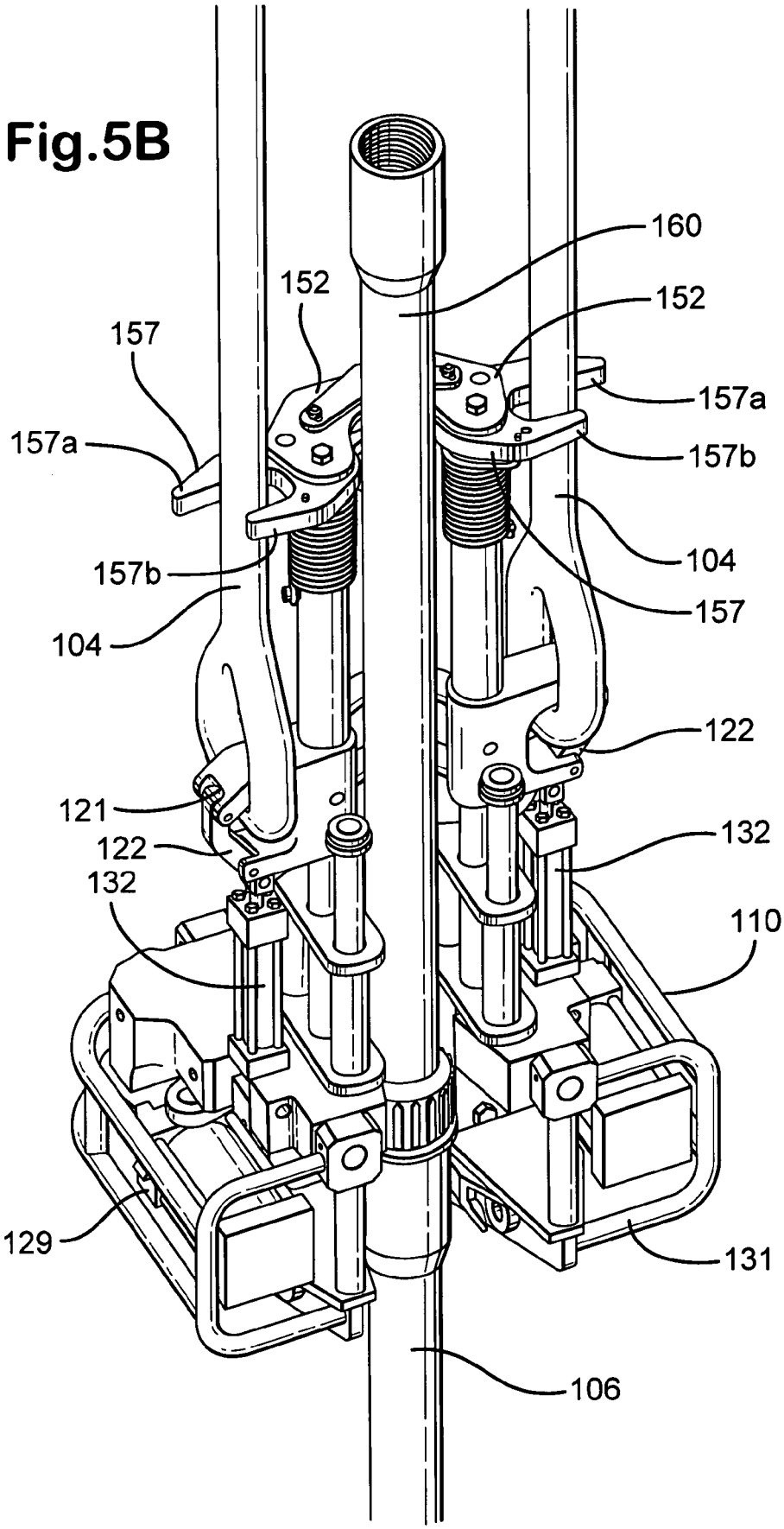
Figure 5C:
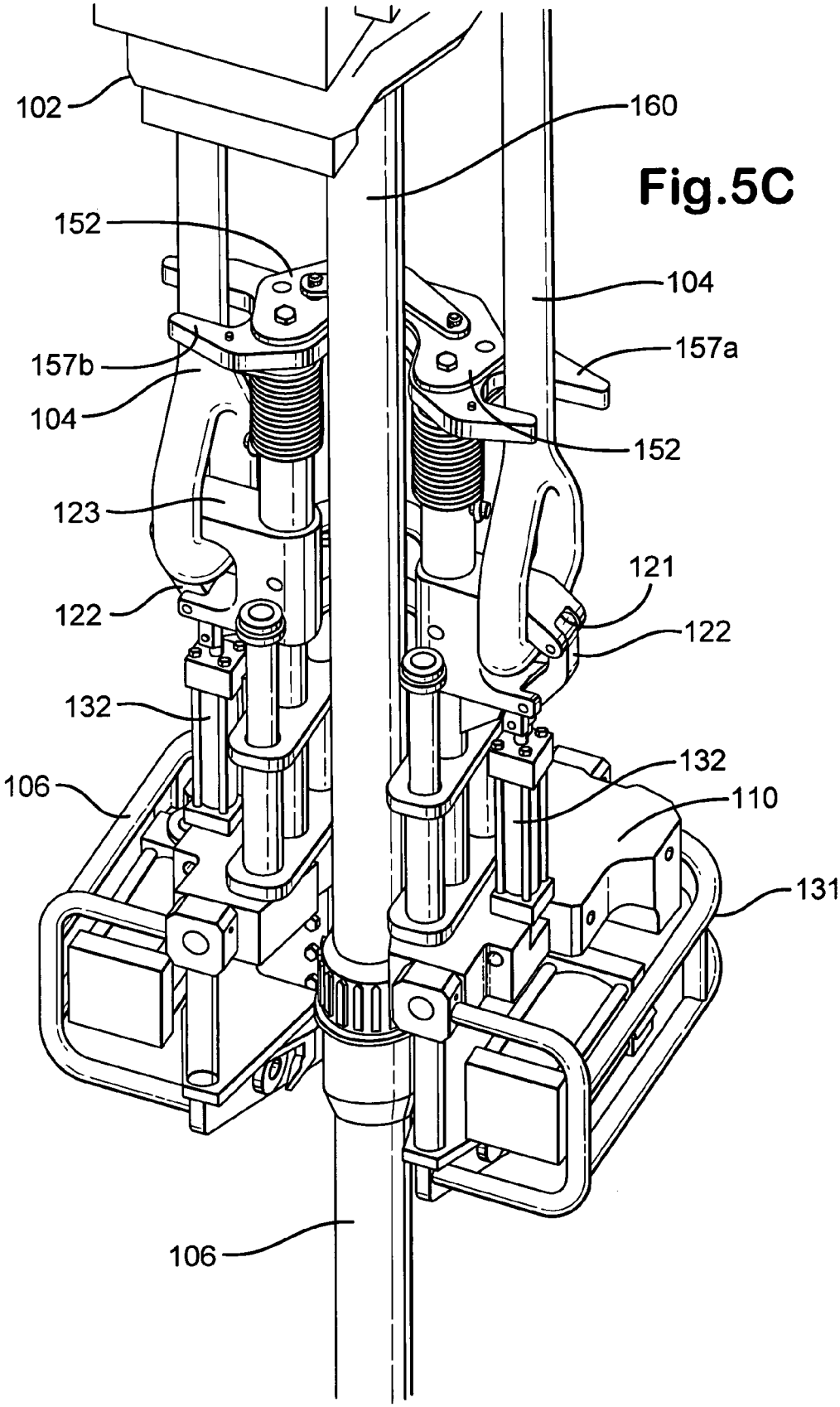
Figure 6:
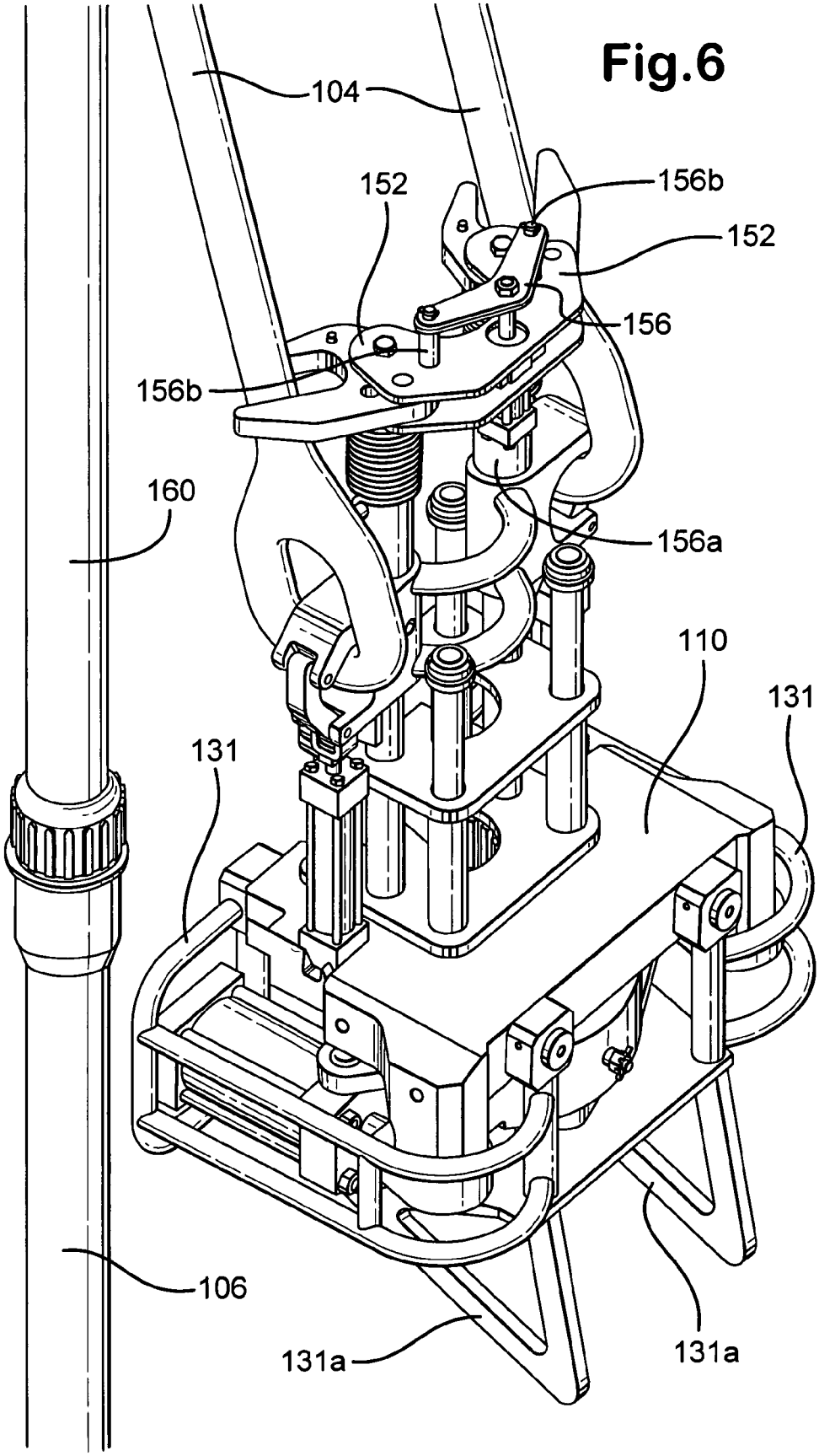

FIGS. 4-6 show a system 100 according to the present invention which has a top drive drilling unit 102. Main links 104 connect the top drive 102 to eyes 121 of a support system 120. A pipe gripper system 110 is connected to and supported by the support system 120. A saver sub 160 is connected to a rotatable by the top drive drilling unit 102. The saver sub 160 is threadedly connected to a top drill pipe 106 of a drill string 108. The saver sub 160 is positioned for being gripped and rotated by the pipe gripper system 110. An elevator (not shown), which in one aspect is similar to the elevator 40 described above or to elevators according to the present invention described below, is located below the pipe gripper system 110. The elevator is connected to the pipe gripper system 110 and, in one particular aspect, is connected as is the elevator 40 to the pipe gripper system 50, described above.

Each eye 121 has a movable lockable latch 122 which can be selectively opened for receiving a lower ring 104*a*. Each eye 121 has a body 123 with a shaft 125. Optionally, springs 126 encircle top portions of the shafts 125 and serve as shock absorbers for a holding mechanism 150. Studs 127 abut lower ends of the springs 126 and hold them in position on the shafts 125.

As shown in FIG. 5A a holding mechanism 150 has a housing 151 (with plates 151*a*, 151*b*) to which are pivotally connected two generally horseshoe-shaped open-throated members 152. Each member 152 pivots on a shaft 125. To selectively prevent such pivoting, a bolt 156*c* is inserted through the members 152, each with an open throat 155 within which is releasably positioned part of a shaft 104*b* of a main link 104. A plate 156 is movably and releasably connected to the housing 151 by a rod 156*b* of a piston/cylinder apparatus 156*a*. With the bolts 156*c* lowered and in place, the main links 104 are held within the throats 155 which are sufficiently long so that the main links 104 as shown in FIG. 5A cannot move out of the throats 155 when in position as in FIG. 5A. With the bolts 156*c* removed when the cylinder 156*a* raises the plate 156, the members 152 are free to pivot and, thus, the main links 104 are freed to move away from the throats 155.

The support system 120 has piston/cylinders 128 for moving the gripper system 110 up and down. Upper ends of housings 132 are secured to the bodies 123 and lower ends of the housings 132 are secured to a main body 129 of the pipe gripping system 110. Optional protective railings 131 connected to the main body 129 encompass part of the perimeter of the pipe gripping system 110. Mounting posts 128*c*, move in corresponding tubes 128*a*.

FIG. 5B shows the entire saver sub 160. FIG. 6 shows the members 152 pivoted with respect to the links 104 and the gripper system 110 moved away from and hanging substantially parallel to a vertical axis of the saver sub 160 and drill pipe 106. Optional skid pieces 131*a* are slanted to facilitate movement of the gripper system 110 past apparatus with which it may come in contact as it is lowered (e.g. a CCS system).

FIGS. 6A-22B illustrate steps in certain methods according to the present invention with certain embodiments of apparatuses according to the present invention. FIGS. 6A-14 illustrate one method according to the present invention for running pipe into a hole (wellbore); and FIGS. 15A-22B illustrate one method according to the present invention for pulling pipe out of a hole.

Figure 6A:
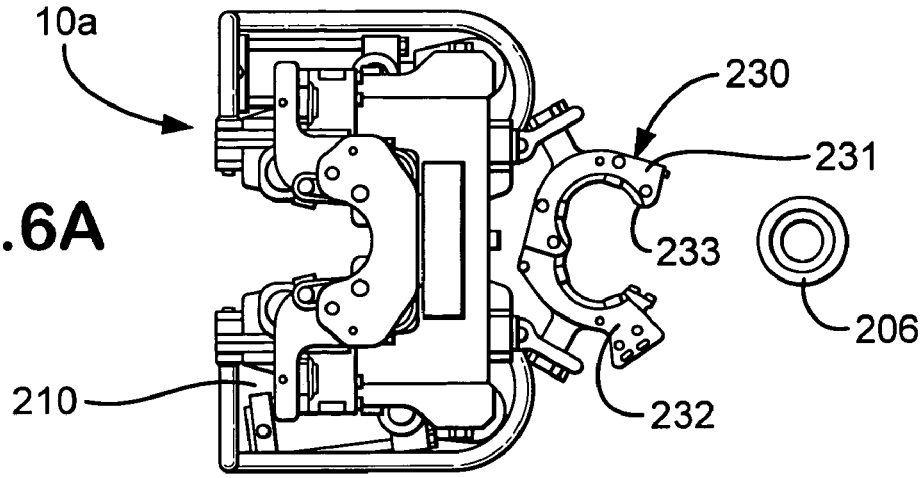
FIG. 6A is a top view of part of the system of FIG. 6B.
Figure 6B:
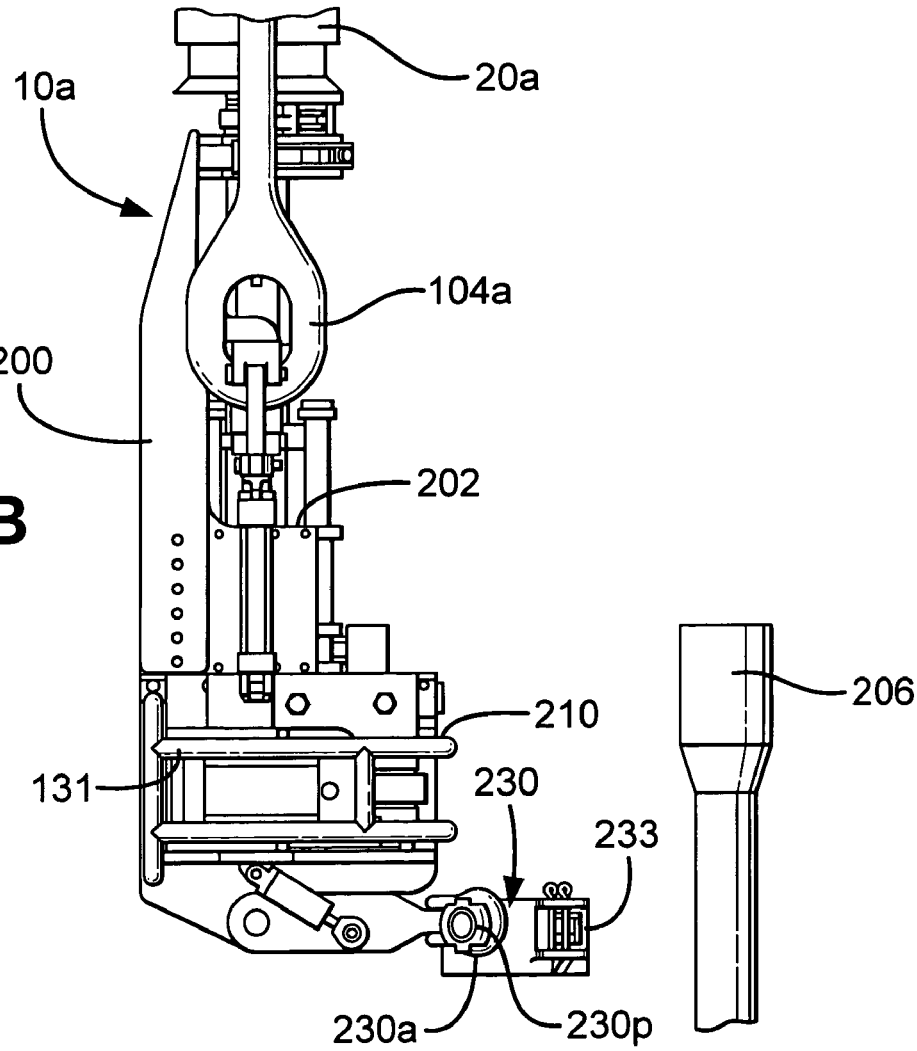
FIG. 6B is a side view of a system according to the present invention.

As shown in FIGS. 6A and 6B a system 10*a* (like the system 10 described above) has a top drive drilling system 20*a* ("top drive"; shown partially) from whose links 104*a* is suspended a connection tool system 200 ("CONN TOOL") in some of the drawing figures. A support apparatus 202 supports a gripper system 210 (like the pipe gripper 50, gripper system 110 or any gripper system according to the present invention) to which is secured a dual sided elevator 230. A front end 233 of the elevator 230 has opposed elevator halves 231, 232 in an open position for receiving, encompassing, and supporting a piece or stand of drill pipe 206. In one embodiment, to initiate the sequence of steps shown in FIGS. 15A-22B, a driller at a driller's console (see FIG. 2, console DC) presses a selected button and the sequence is begun.

Figure 6C:
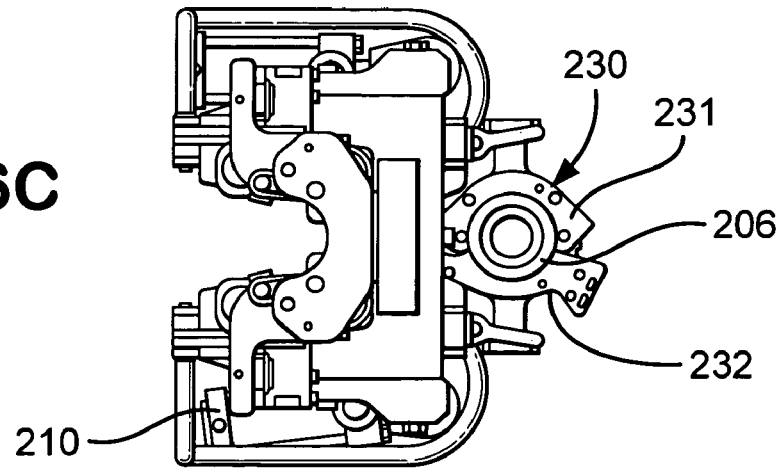
FIG. 6C is a top view of part of the system of FIG. 6B.
Figure 6D:
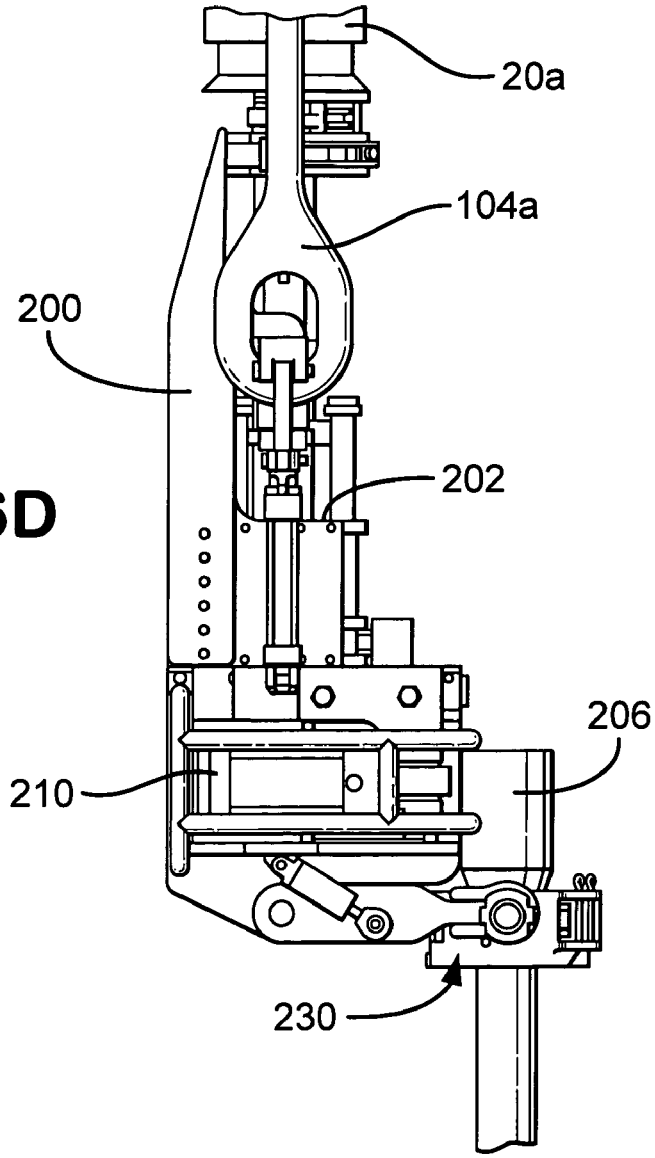
FIG. 6D is a side view of the system as shown in FIG. 6C.

As shown in FIGS. 6C, 6D, the drill pipe 206 has been moved (manually by a derrickman or by a machine) into the elevator 230 and the elevator 230 has been closed shut around the drill pipe 206 (e.g. a derrickman uses an hydraulic system to close the elevator).

Figure 6E:
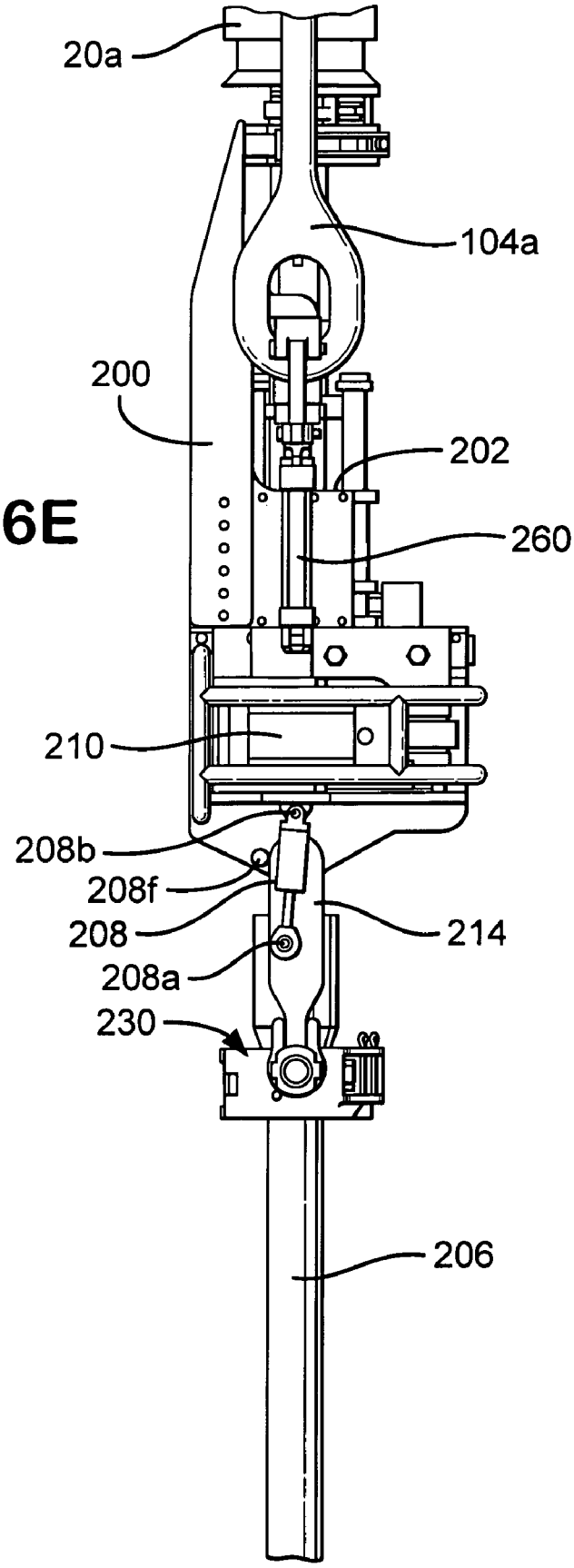
FIG. 6E is a side view of the system of FIG. 6C.

FIG. 6E illustrates the drill pipe 206 being lifted into position off a rig floor to a location above a continuous circulation system 240 (see FIG. 7A) which may be any continuous circulation system referred to herein. As shown in FIG. 6E as compared to FIG. 6B, the elevator 230 has moved below the gripper system 210 and the drill pipe 206 is lined up generally with a longitudinal axis of a saver sub 260 (like the saver sub 160 or any saver sub referred to herein). Such alignment is facilitated by an over center connection of ends 208*a* of piston/cylinder devices 208 (see also FIG. 8) to links 214. The devices 208 urge the elevator 230 toward the position shown in FIG. 6B. Other ends 208*b* of the piston/cylinder devices 208 are connected to the gripper system 210. The elevator 230 is lowered into the position shown in FIG. 6E by its own weight and by the weight of the drill pipe. The links 214 abut stops 208*f* which prevent the links 214 from moving past the position shown in FIG. 6E and the over center connection of the ends 208*a* facilitates maintaining the elevator 230 and the drill pipe in the position shown in FIG. 6E.

Figure 7A:
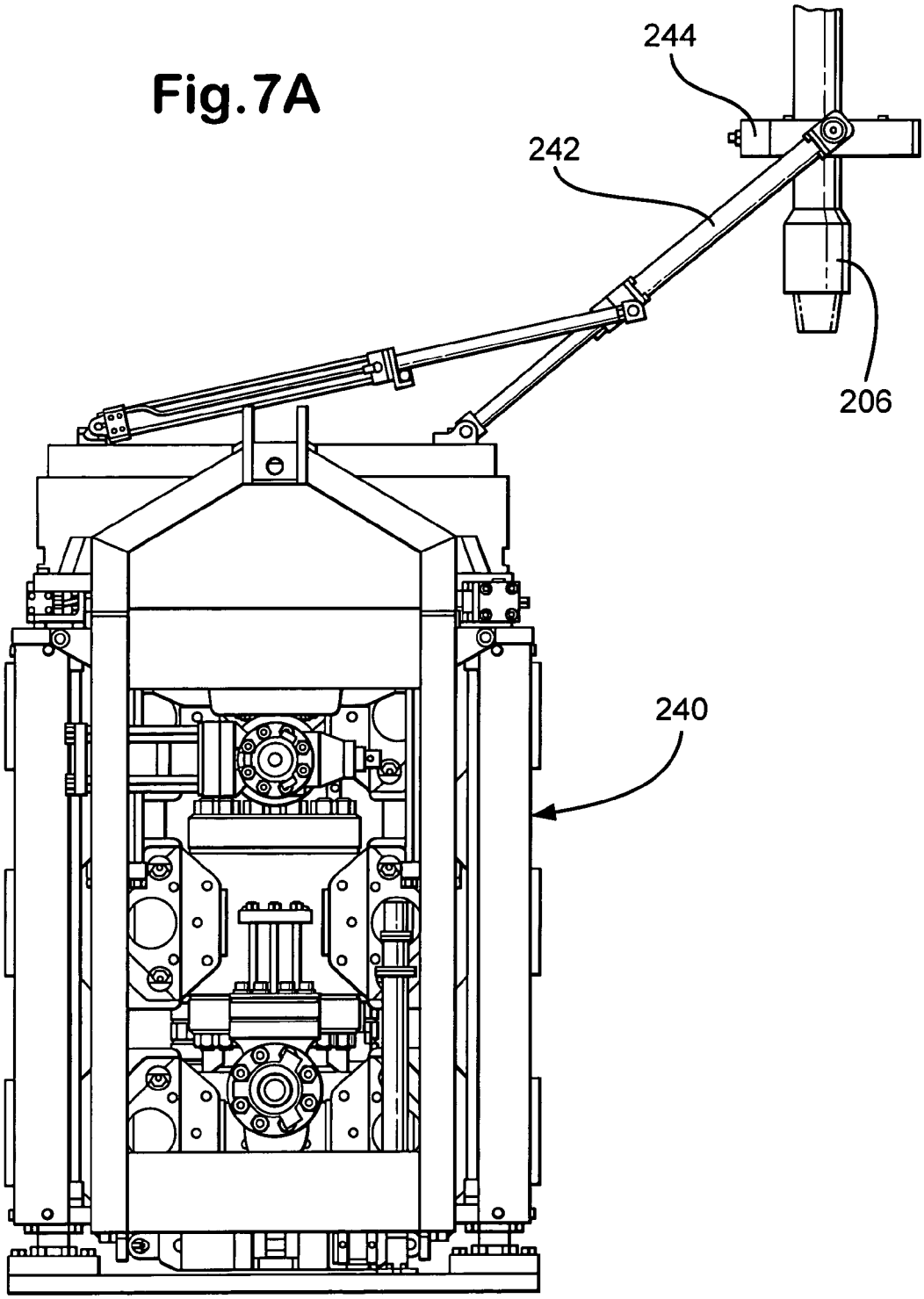
FIGS. 7A, 7B and 7C are side views showing steps in a method according to the present invention using the system of FIG. 6B.

As the driller lifts the drill pipe 206 as shown in FIG. 6E a roughneck places the drill pipe 206 in holder 244 of a pipe guide 242 of the continuous circulation system 240 ("system 240") as shown in FIG. 7A. The system 240 is positioned as is the CCS 30 in FIG. 2.

Figure 7B:
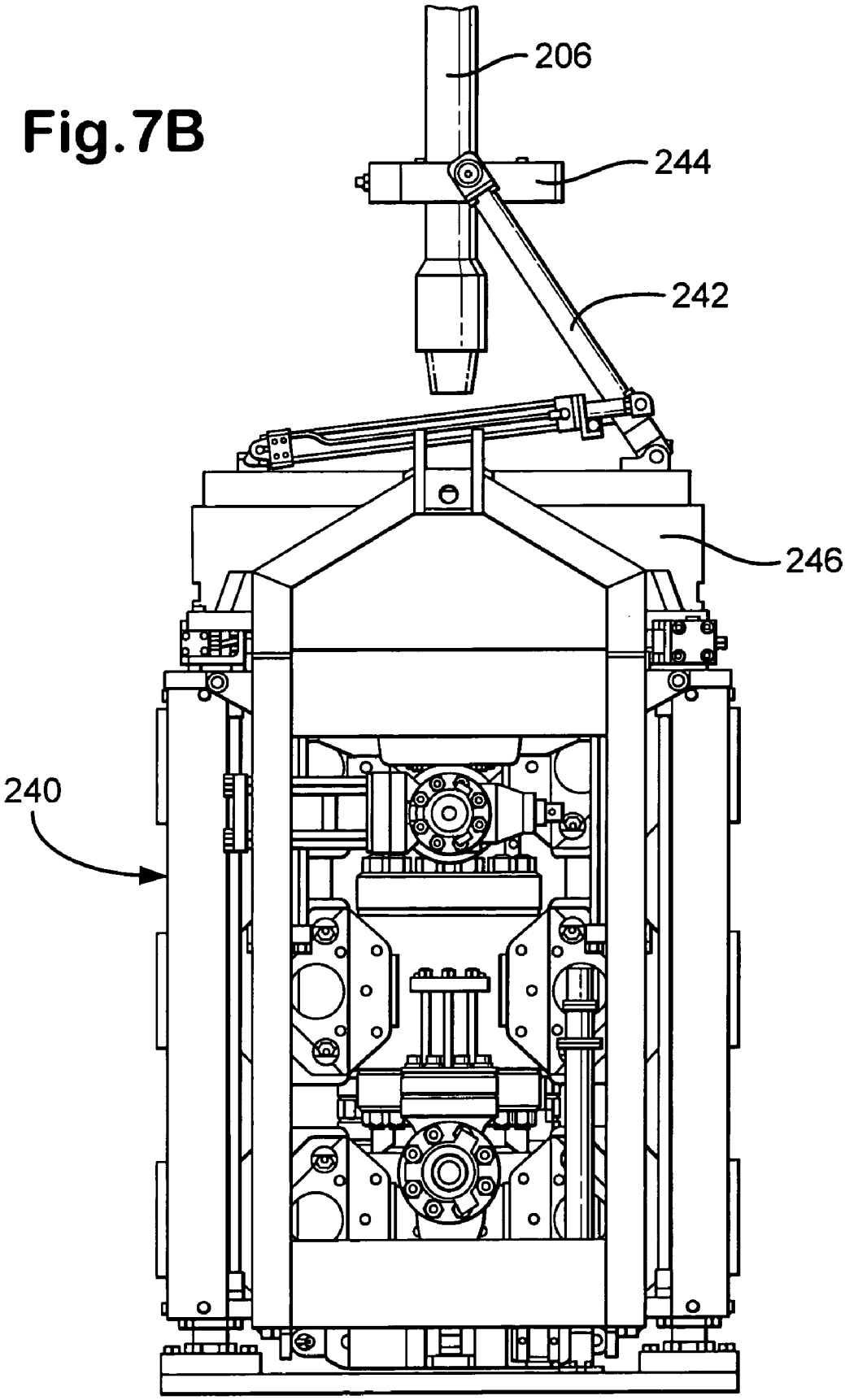
Figure 7C:
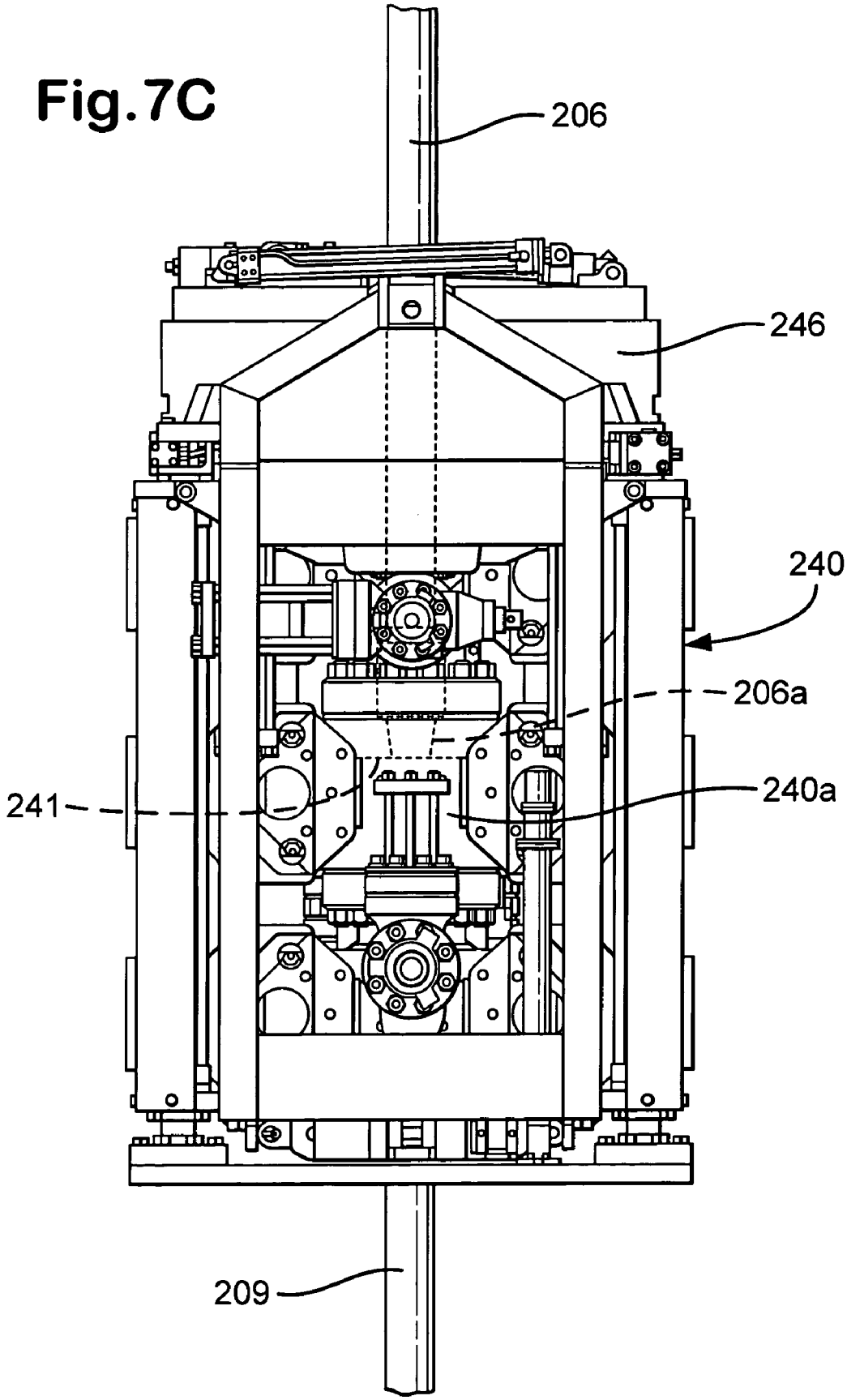

FIG. 7B illustrates the driller stabbing the drill pipe 206 into the system 240 after the pipe has been correctly aligned with the system 240 using the pipe guide 242. A snubber 246 of the system 240 selectively grips the pipe. As shown in FIG. 7C jaws (not shown) in the snubber 246 close on and grip the drill pipe 206 whose bottom end 206*a* is not yet connected to a drill string 209 whose upper end is held within the system 240. The bottom end 206*a* of the drill pipe 206 rests on top of blind ram blocks 241 (shown by a horizontal dotted line) of a middle pressure chamber of the system 240.

Figure 8:
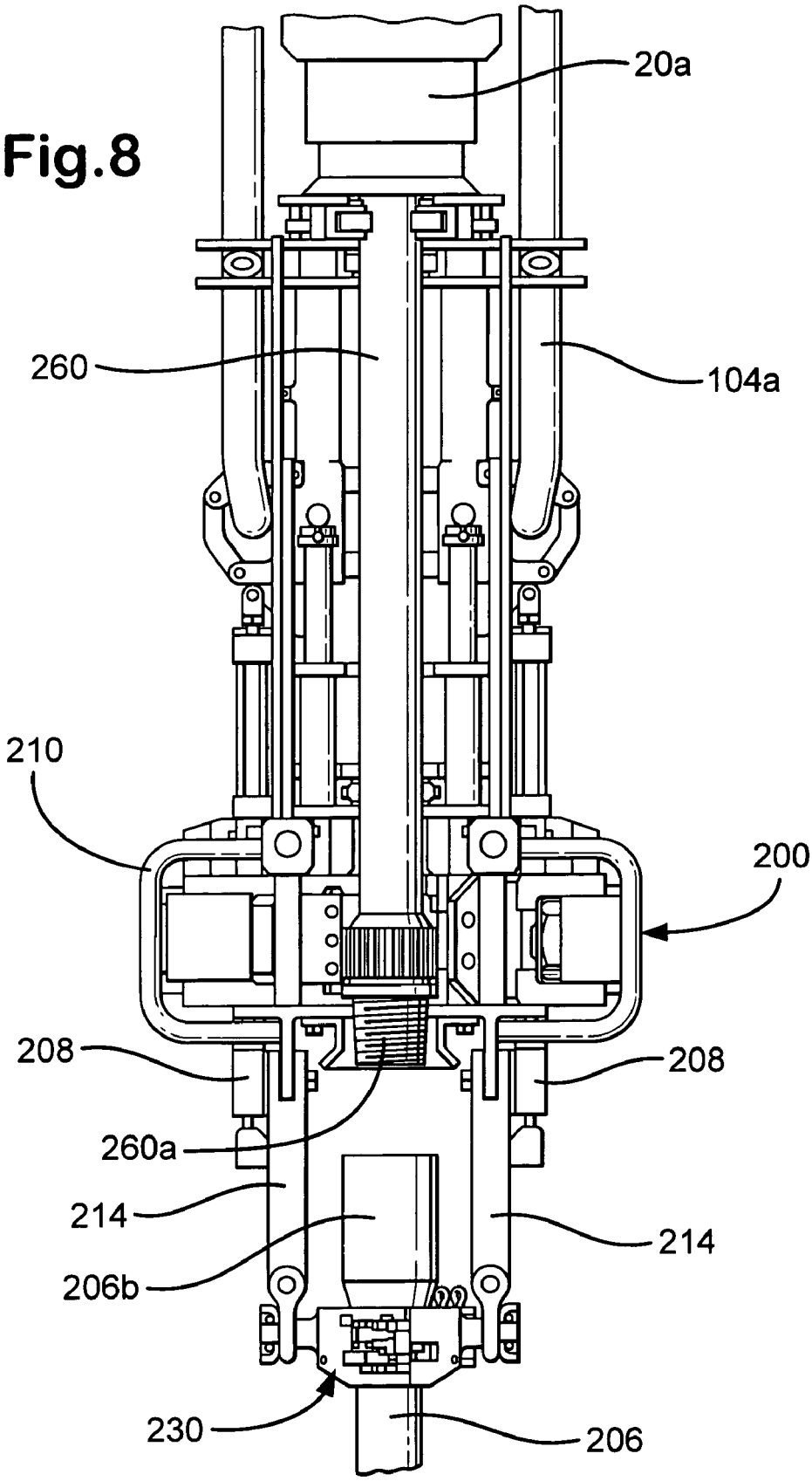
FIGS. 8 and 9 are front views showing steps in a method according to the present invention using a system as in FIG. 6B.
Figure 9:
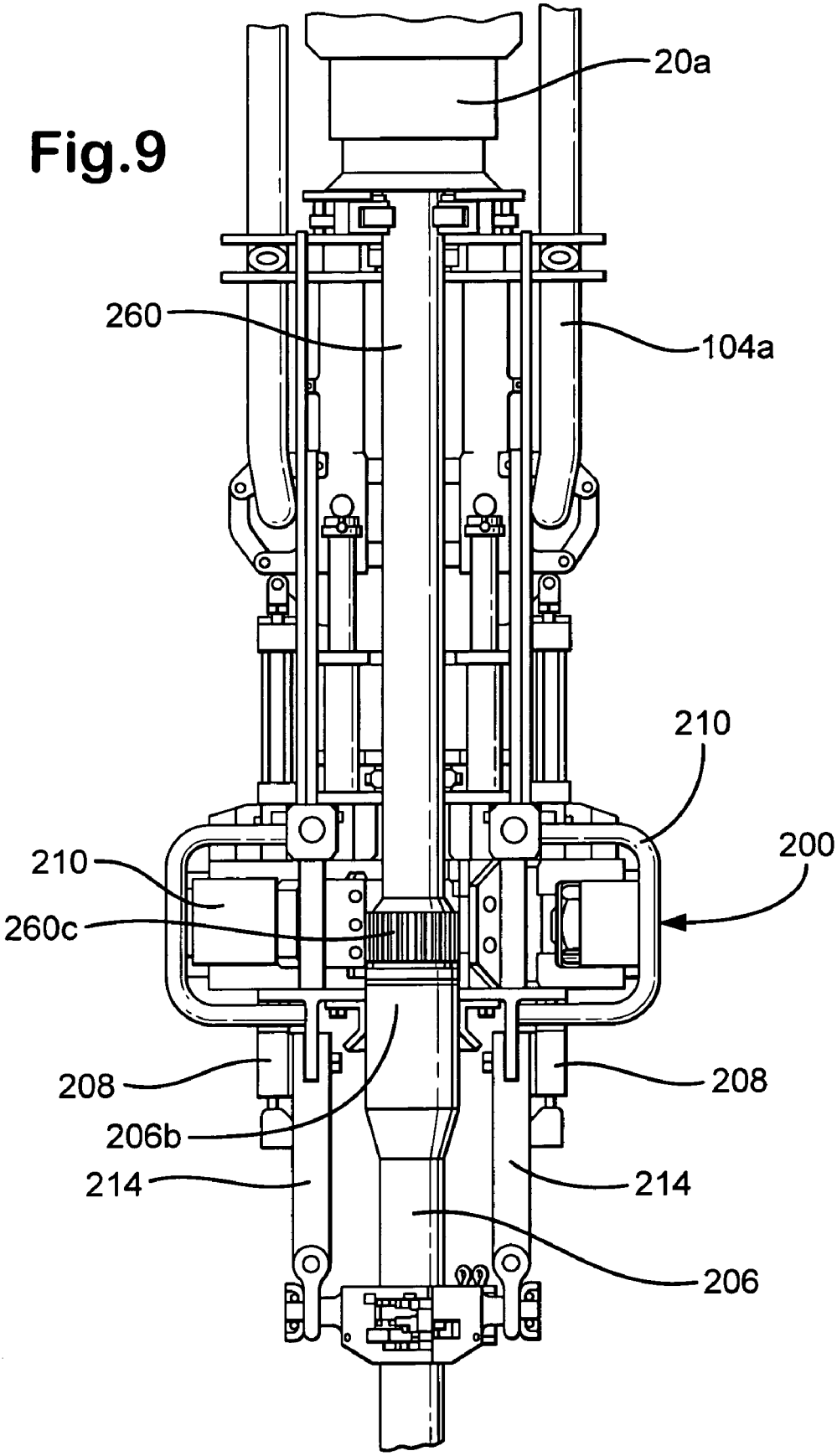

FIGS. 8 and 9 illustrate steps in connecting the lower end of the saver sub 260 to an upper end 206*b* of the drill pipe 206. As shown in FIG. 8 the saver 260 is positioned for lowering down to the drill pipe 206. The top drive 20*a* and the system 200 are lowered to stab a lower end 260*a* of the saver sub 260 into the top end 206*b* of the drill pipe 206. In the position shown in FIG. 9 the jaws of the gripper system 210 are not gripping this splined portion 260*c*.

The top drive 20*a* rotates the saver sub 260 while the snubber 246 holds the drill pipe 206 thereby making-up the connection between the saver sub 260 and the drill pipe 206.

Figure 10A:
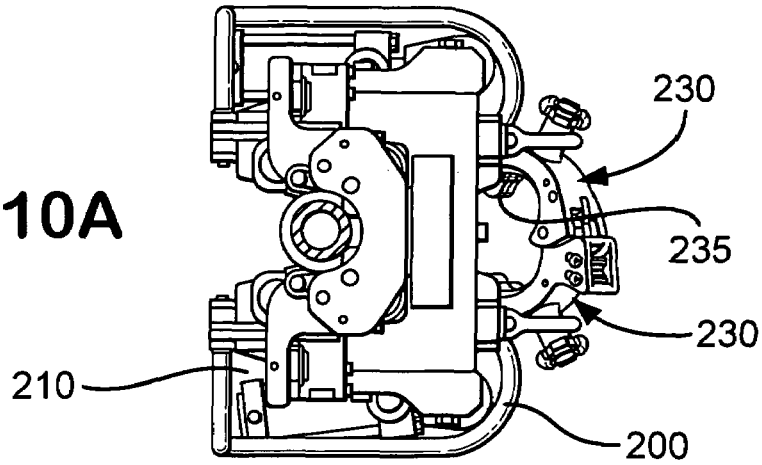
FIGS. 10A, 11A, 12A, and 13A are top views showing steps in a method according to the present invention using a system as in FIG. 6B.
Figure 10B:
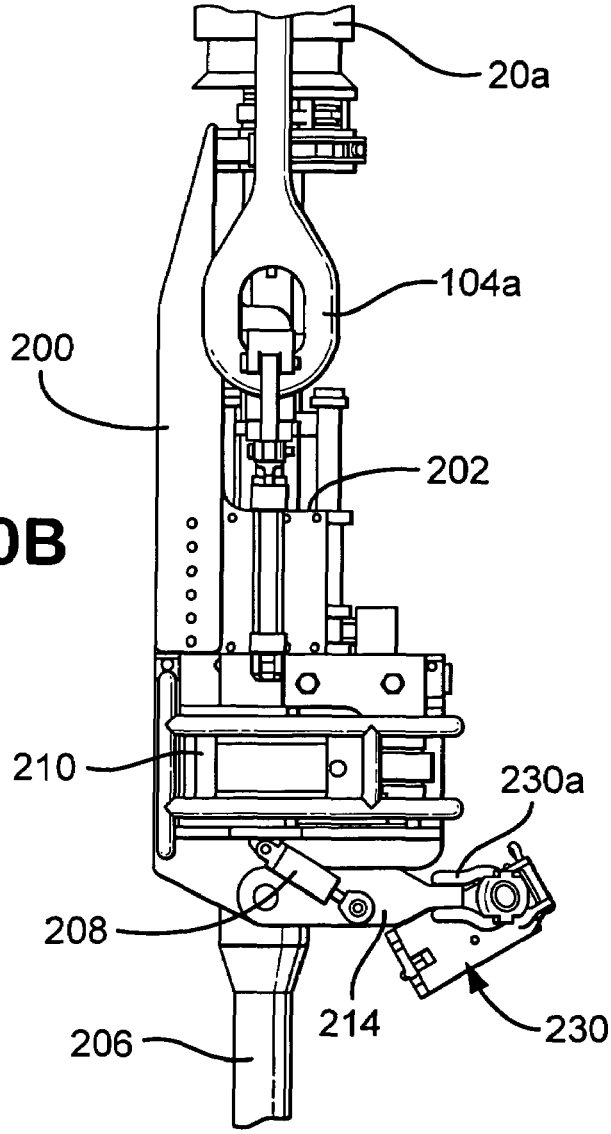
FIGS. 10B, 11B, 12B and 13B are side views corresponding to the views, respectively, of FIGS. 10A, 11A, 12A and 13A.
Figure 11A:
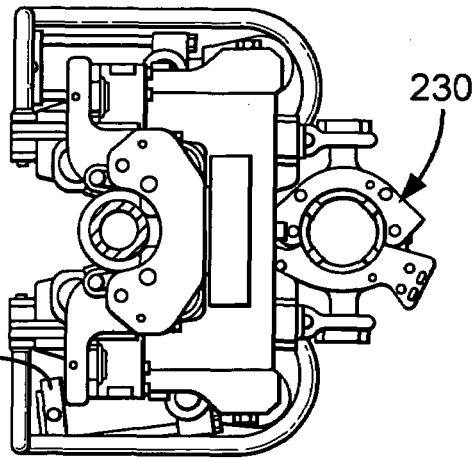
Figure 11B:
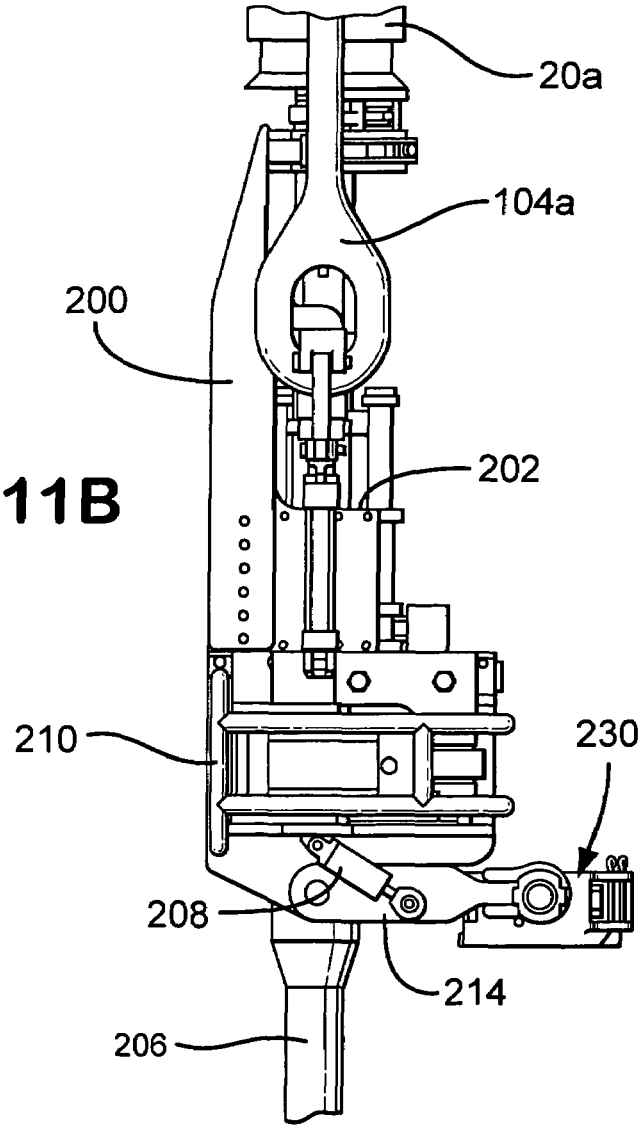

As shown in FIGS. 10A and 10B the derrickman has opened up a back side 235 of the elevator 230 by manually unlatching the elevator halves 231, 232, releasing the elevator 230 from the drill pipe 206 and moving it off the wellbore centerline; and the devices 208 have retracted the elevator up and away from the drill pipe 206. As shown in FIGS. 11A, 11B the back side 235 of the elevator 230 has been closed and the elevator halves 231, 232 are again latched shut.

Figure 12A:
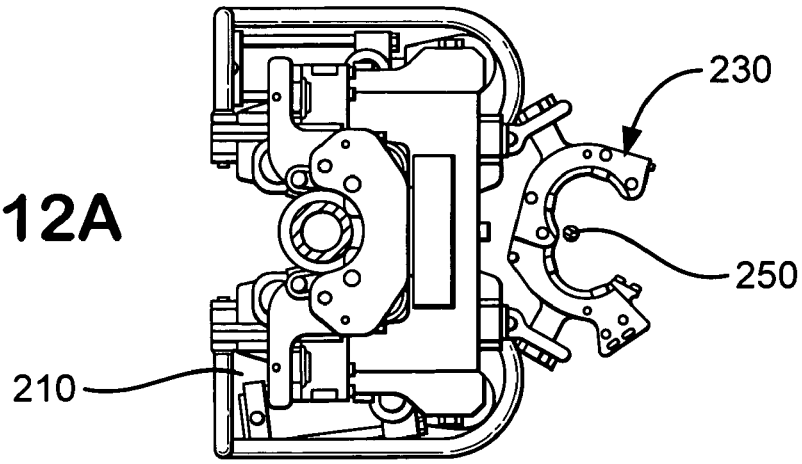
Figure 12B:
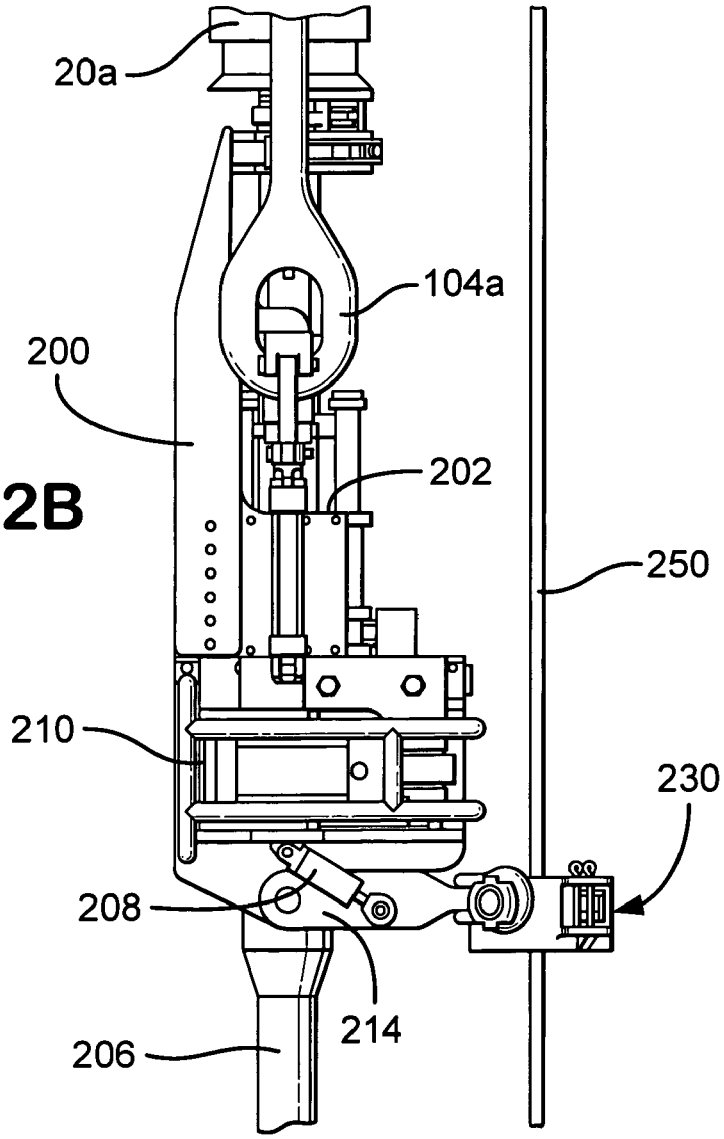
Figure 13A:
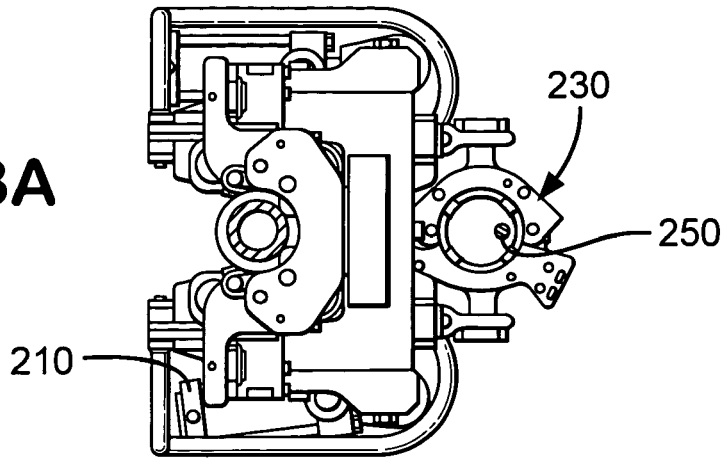
Figure 13B:
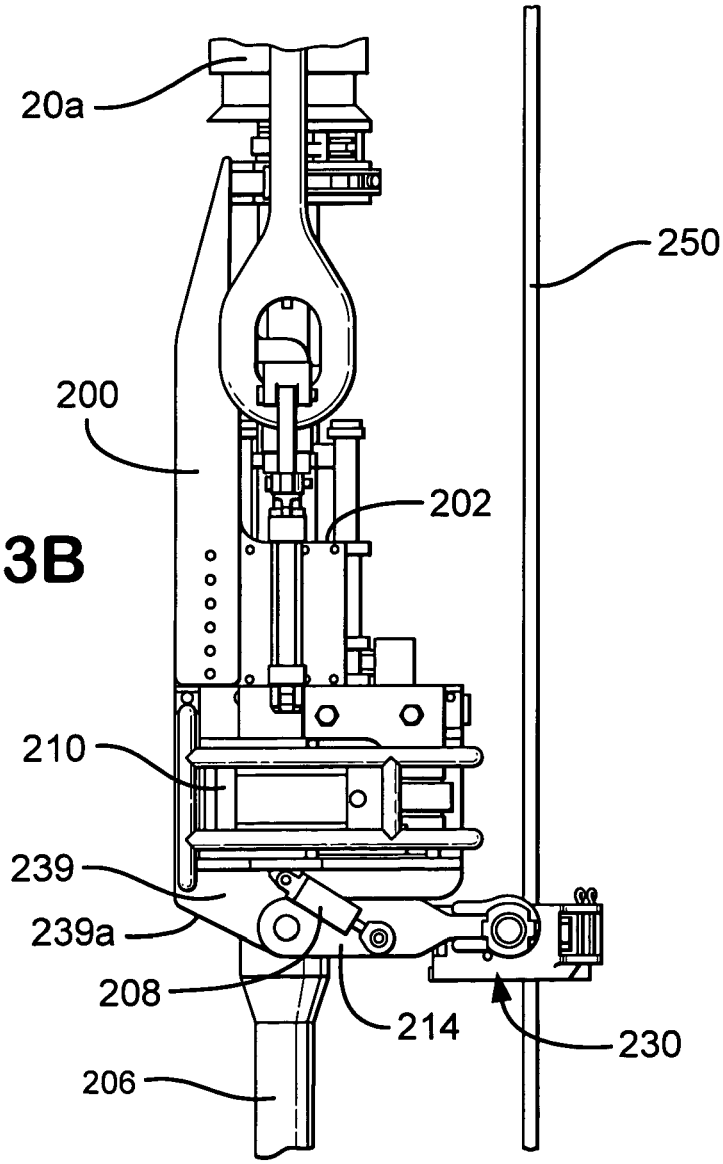
Figure 14:
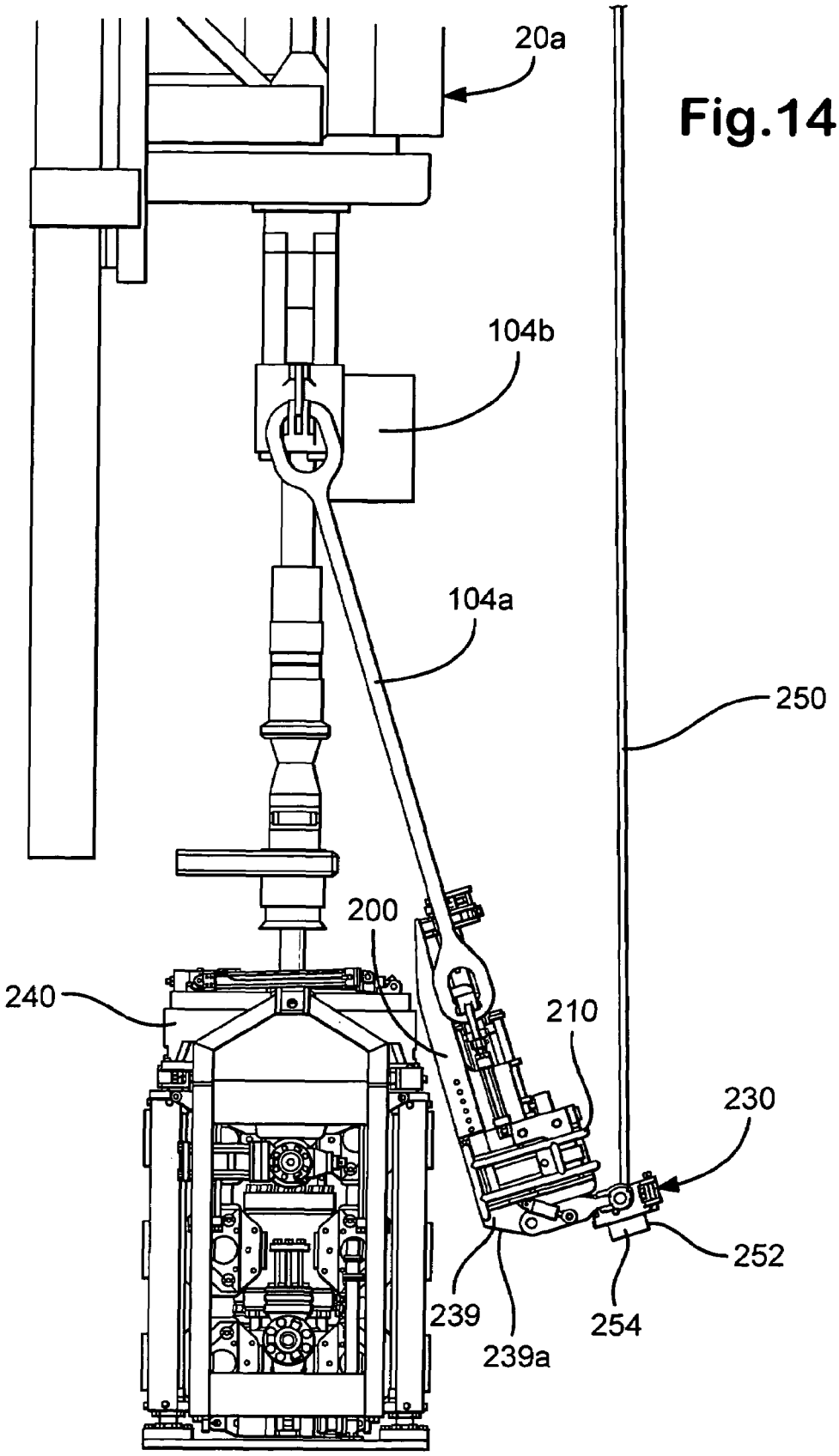
FIG. 14 is a side view of a step in a method according to the present invention using a system according to the present invention as in FIG. 6B.

FIGS. 12A and 12B illustrate the opening of the front end 233 of the elevator 230 and positioning a tugger cable 250 within the elevator 230. The tugger cable 250 extends in the derrick (see FIG. 2) and is movable by personnel on the rig floor into position within the elevator 230. FIGS. 13A, 13B show the elevator 230 closed around the tugger cable 250. The tugger cable 250 maintains the elevator 230 and the connection tool system 200 in the position shown in FIG. 13B and in FIG. 14 away from the drill pipe 206 and to a side of the system 240 so that the top drive 20*a* can rotate the drill pipe 206 and the drill string of which it is a part (extending down below the system 240 and the associated drill rig) to drill the wellbore. With the elevator 230 and the system 200 held out of the way, the top drive 20*a* can drill down an entire stand of which the drill pipe 206 is a piece to a point at which the bottom of the saver sub 260 is within the system 240; i.e., drill down can proceed down to a point further than it could if the elevator 230 and the system 200 was still located directly below the top drive 20*a*. The system 240 maintains fluid circulation in the wellbore during connection make-up (e.g. connection of saver sub to drill pipe). A curved or slanted portion 239*a* of a body 239 to which the links 214 are connected facilitates contact of the body 239 by the system 240 and movement of the body 239 past the system 240 in the event of such contact. The lower end of the tugger cable 250 is connected to an anchor 252 with a lower part 254 that is located beneath the elevator 230 and which has a portion larger in diameter than the elevator 230 so that the tugger cable 250 is secured to and held in position with respect to the elevator 230. Optionally, a power system 104*b* (shown schematically, FIG. 14) moves the system 200 out of the way and the tugger cable is not used.

Figure 15A:
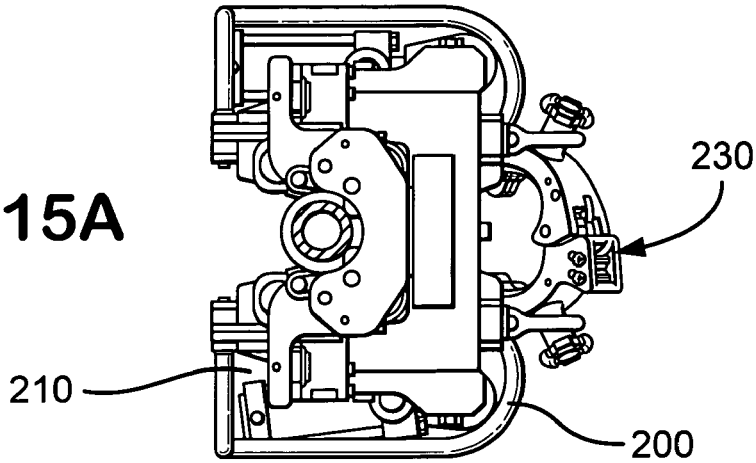
FIG. 15A is a top view showing the use of a system as in FIG. 6B in a step of a method according to the present invention.
Figure 15B:
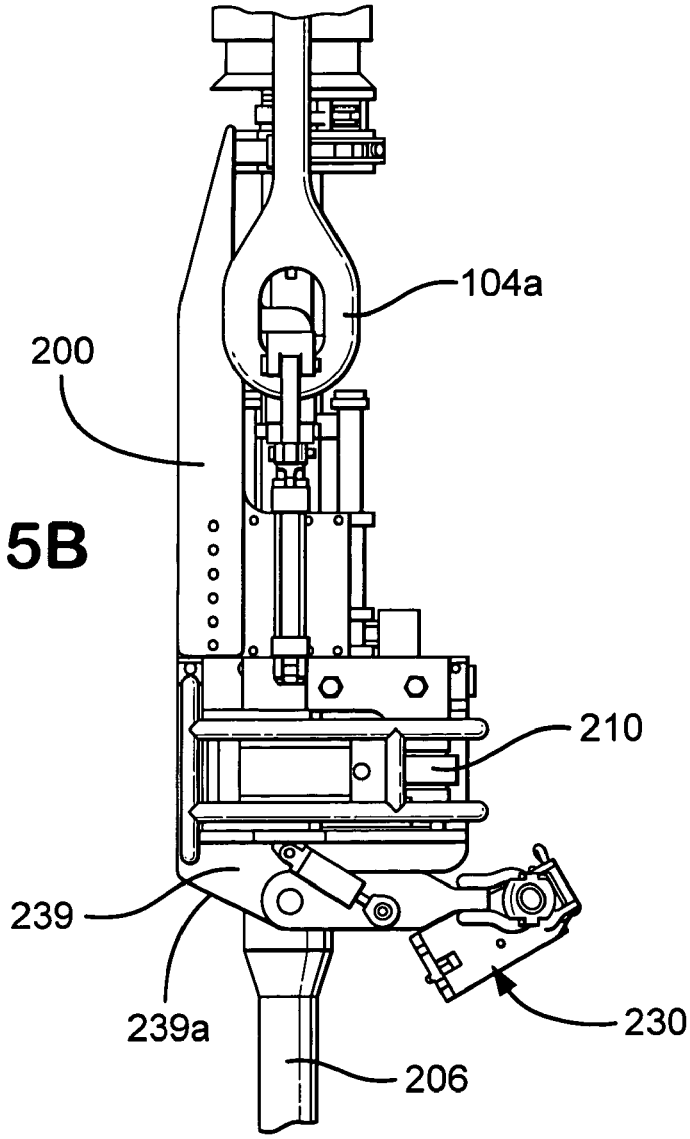
FIG. 15B is a side view of the system corresponding to the top view of FIG. 15A.
Figure 16:
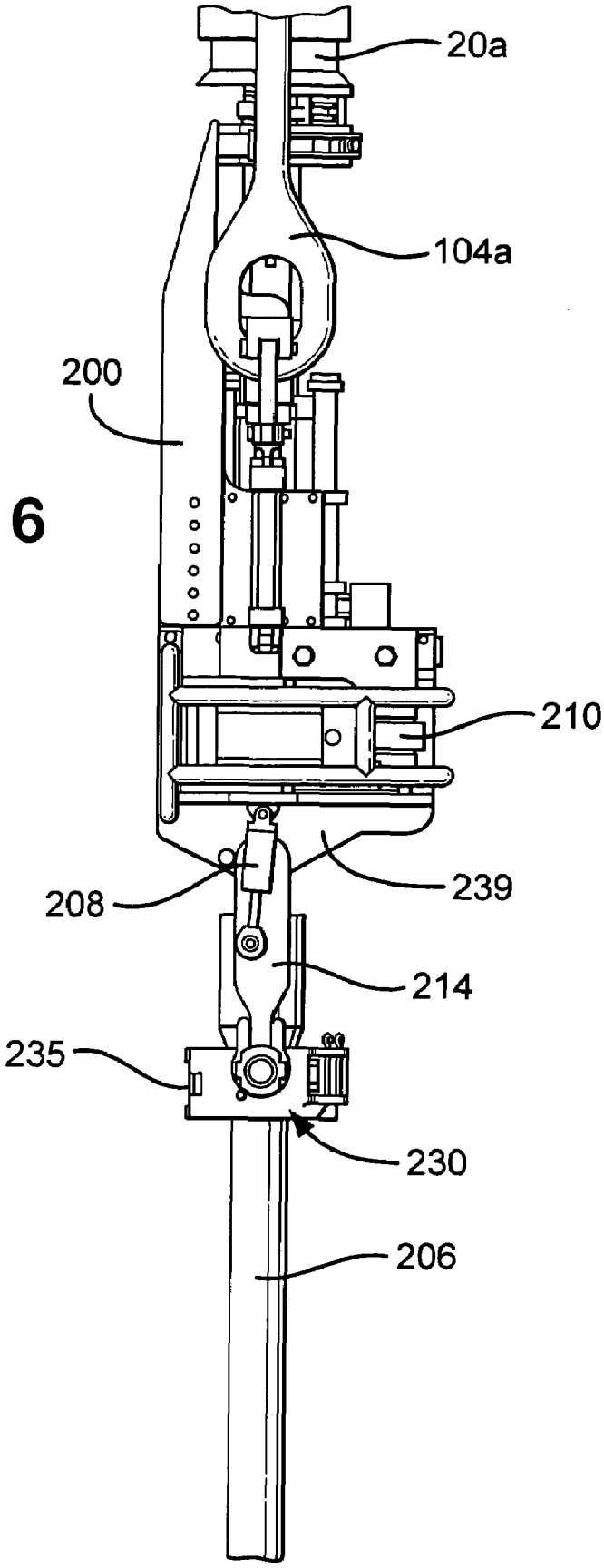
FIG. 16 is a side view of a step in a method according to the present invention using a system according to the present invention as in FIG. 6B.

FIGS. 15A, 15B, and 16 illustrate the beginning of a method according to the present invention for pulling drill pipe out of a hole. In order to latch the elevator 230 onto the drill pipe 206 (top piece in a stand) the back side 235 of the elevator 230 is opened, the elevator is lowered against the force of the devices 208, (FIGS. 15A, 15B) and the elevator is then moved onto the drill pipe 206 (e.g. by a derrickman and/or by venting the devices 208).

Figure 17:
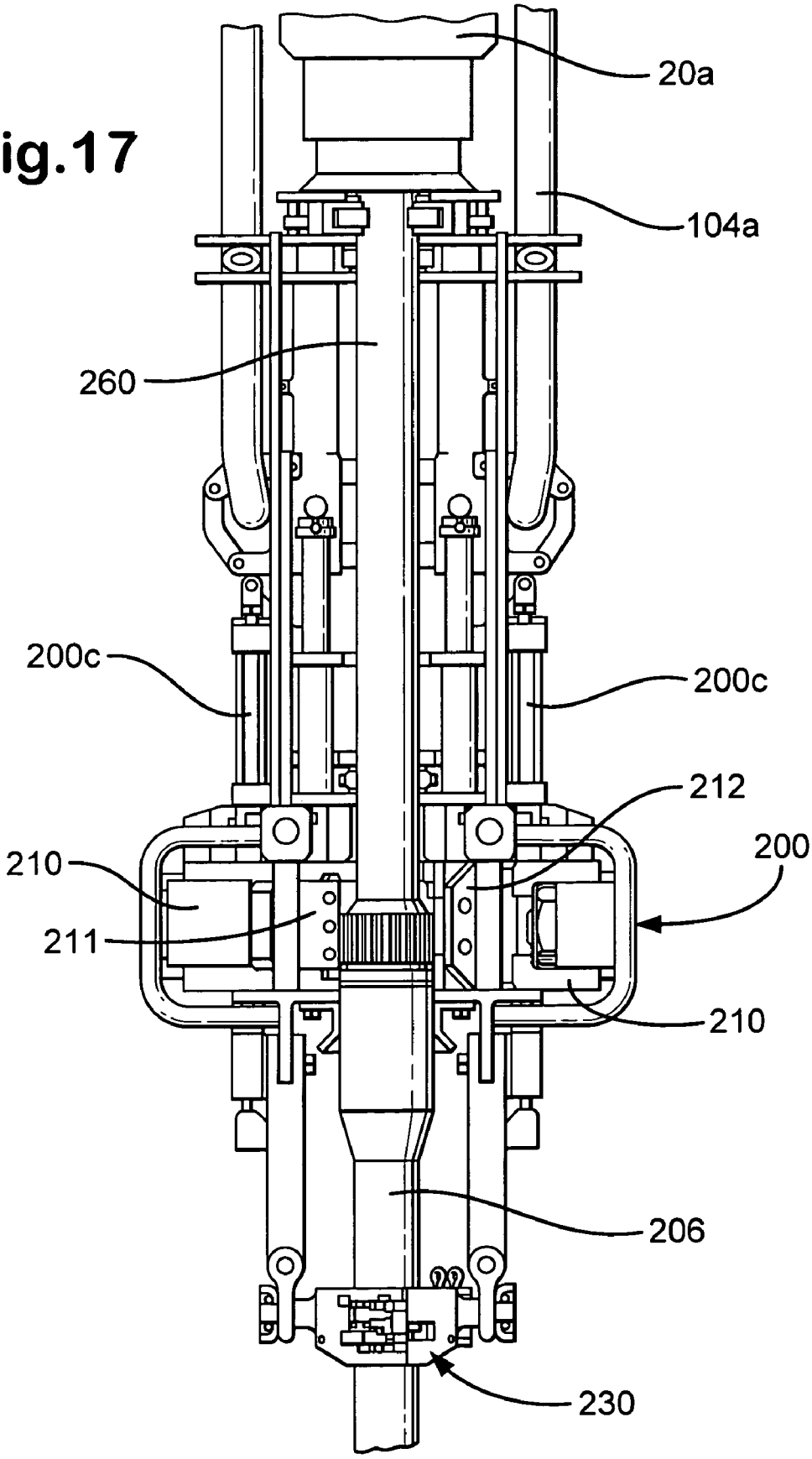
FIGS. 17 and 18 are front views showing steps in a method according to the present invention using a system as in FIG. 6B.
Figure 18:
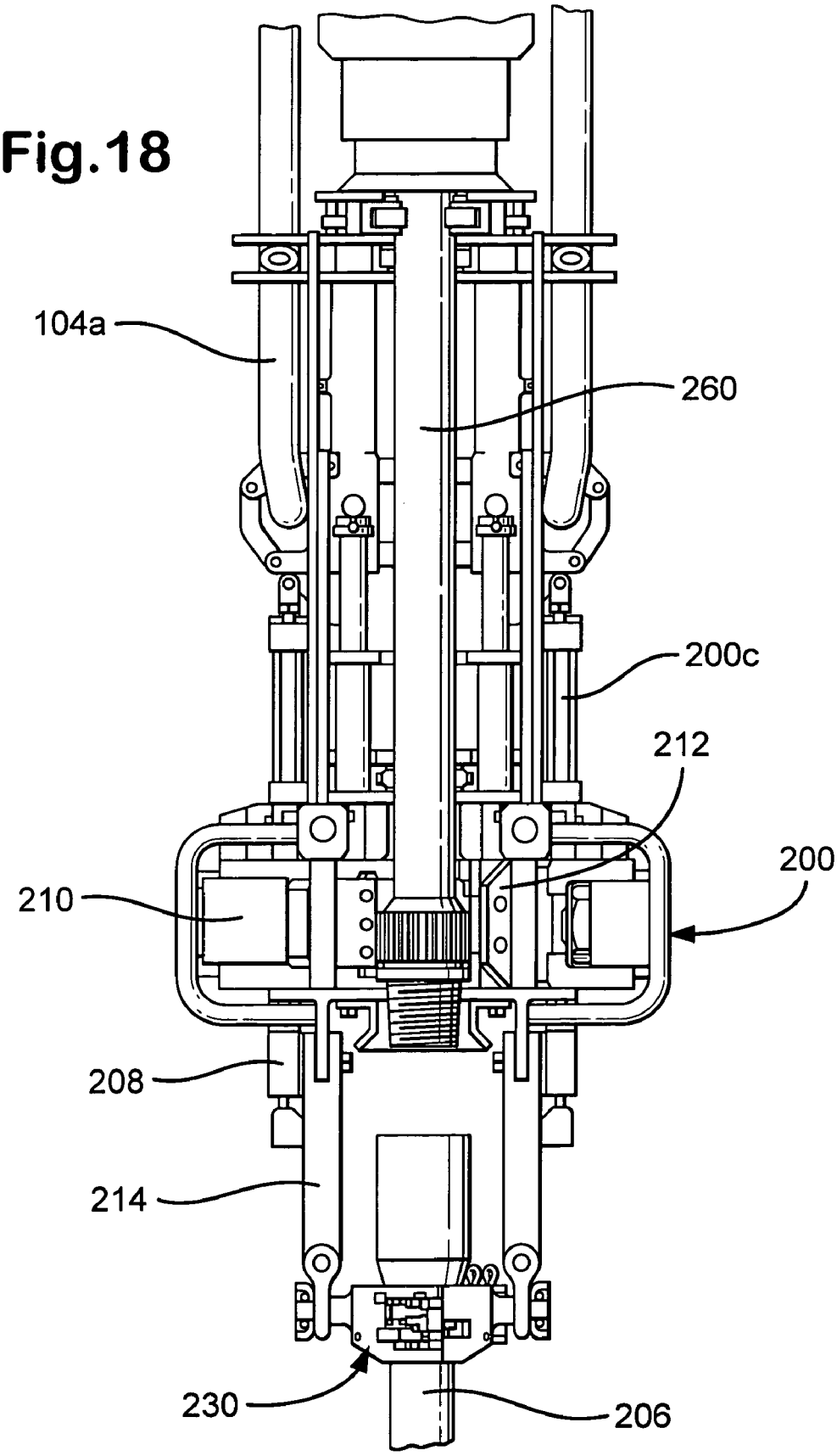
Figure 19:
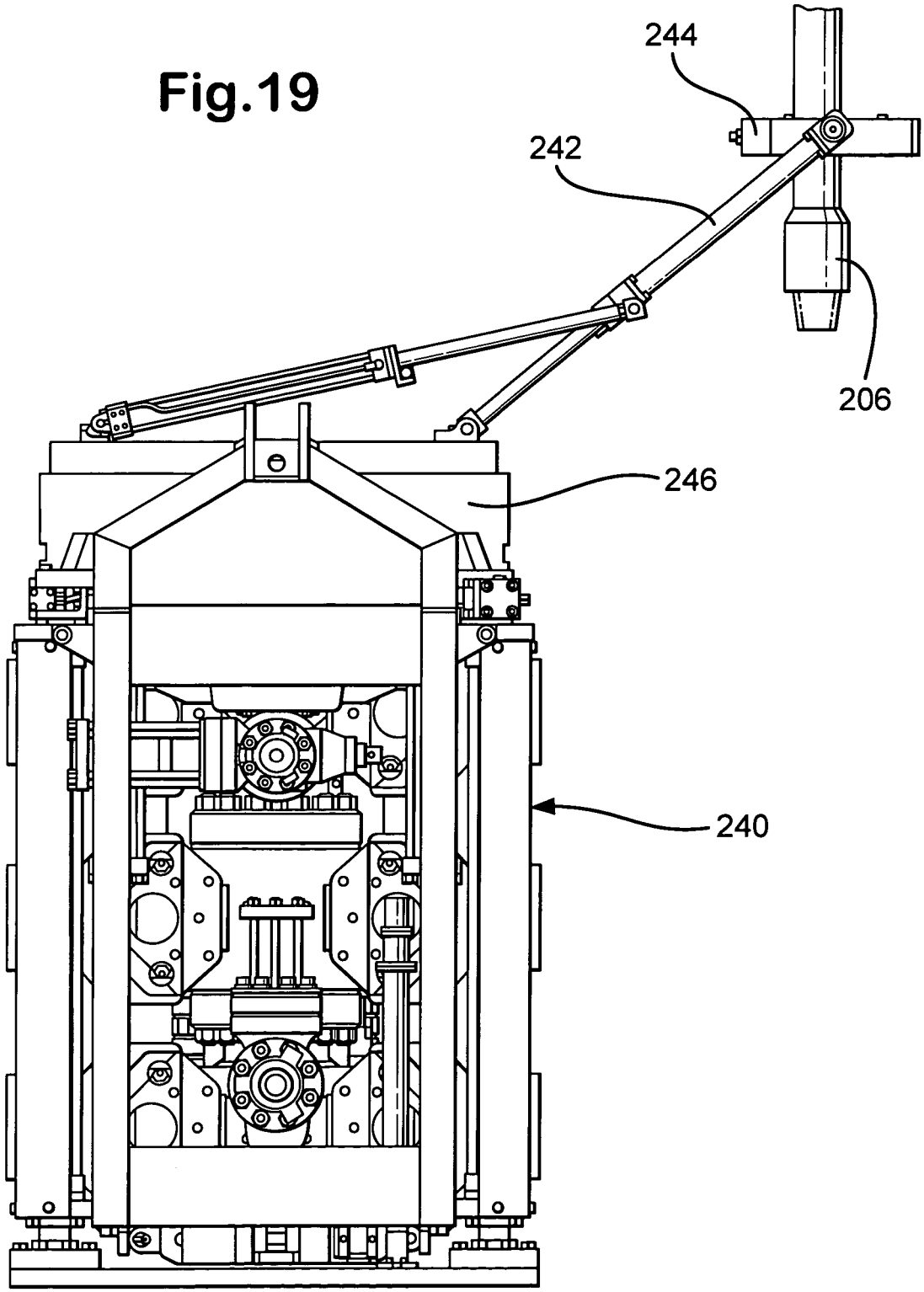
FIG. 19 is a side view showing a step in a method according to the present invention.

As shown in FIG. 17, jaws 211, 212 of the gripper system 210 have closed around and are not gripping the splined portion 260*c* of the saver sub 260 while the snubber 246 of the system 240 holds the drill pipe 206. The jaws 211, 212 are then moved to break the connection between the saver sub 260 and the drill pipe 206. After the step shown in FIG. 17, the gripper system 210 is lowered so that its jaws grip the drill pipe 206 and then its jaws break the saver-sub/drill-pipe connection. Hydraulic cylinder devices 200*c* move the gripper system 210 down. Once the connection is broken, the top drive 20*a* rotates the saver sub 260 to totally disconnect the saver sub 260 from the drill pipe 206. As shown in FIG. 18, the drill pipe 206 has been released from the snubber 246, the top drive 20*a* and the connection tool system 200 is raised away from the drill pipe 206 with the drill pipe 206 still within the elevator 230 and with the bottom end 206*a* in a position as shown in FIG. 7C. The driller then picks up the stand of drill pipe with the top drive system, deploys the pipe guide 242 over the center of the system 240, and grasps the drill pipe with the holder 244 of the pipe guide 242, then, as shown in FIG. 19, the stand of drill pipe is moved away from the system 240 using the pipe guide 242.

Figure 20A:
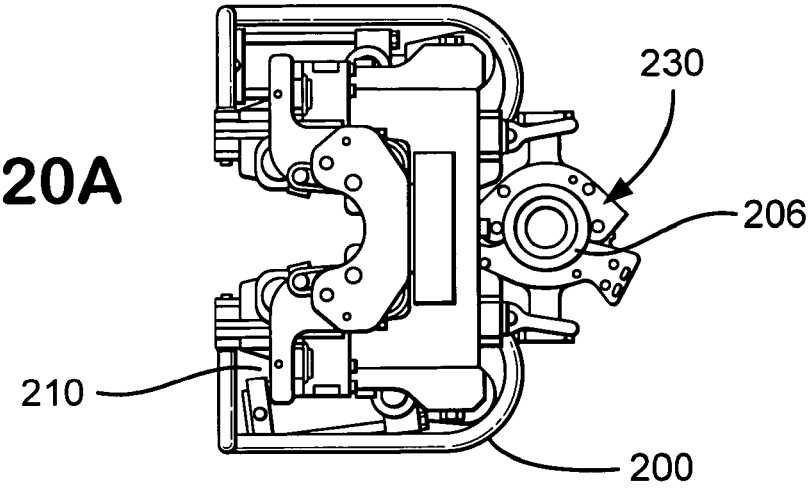
FIGS. 20A, 21A, and 22A are top views showing steps in a method according to the present invention using a system as in FIG. 6B.
Figure 20B:
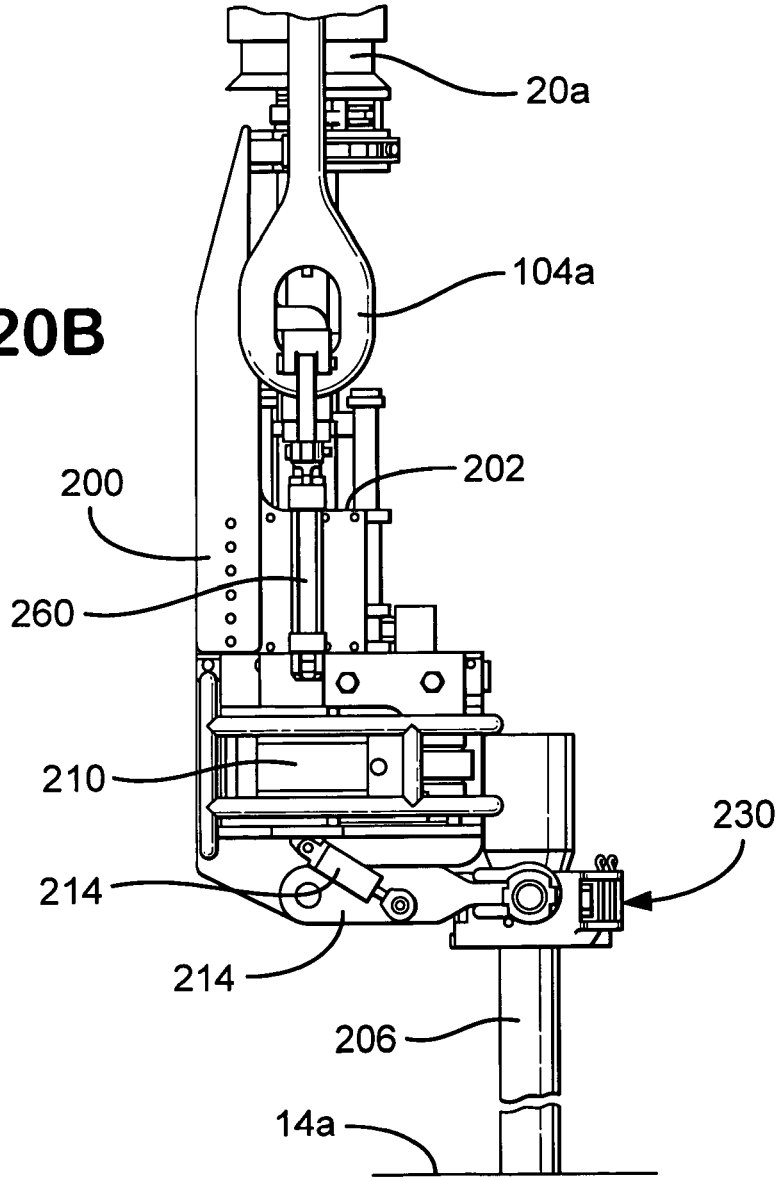
FIGS. 20B, 21B and 22B are side views corresponding to the views, respectively, of FIGS. 20A, 21A and 22A.

As shown in FIGS. 20A, 20B the drill pipe stand is then lowered so its bottom end rests on a rig floor 14*a*.

Figure 21A:
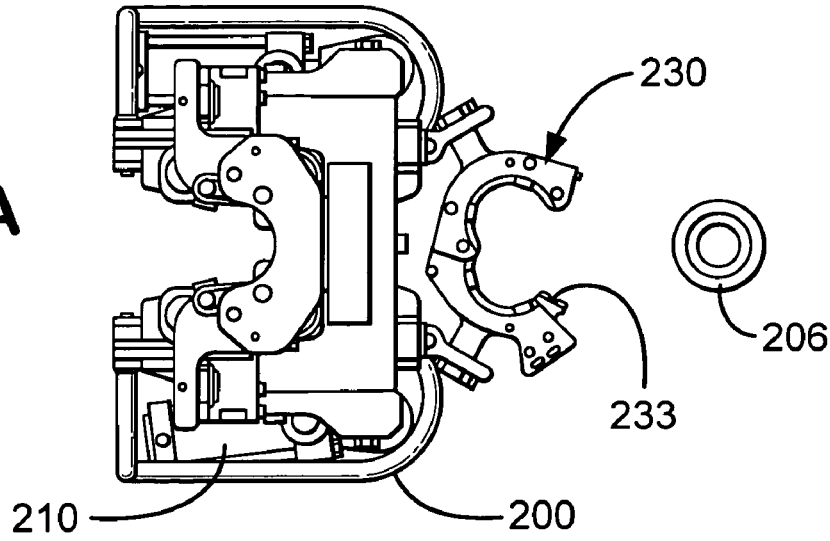
Figure 21B:
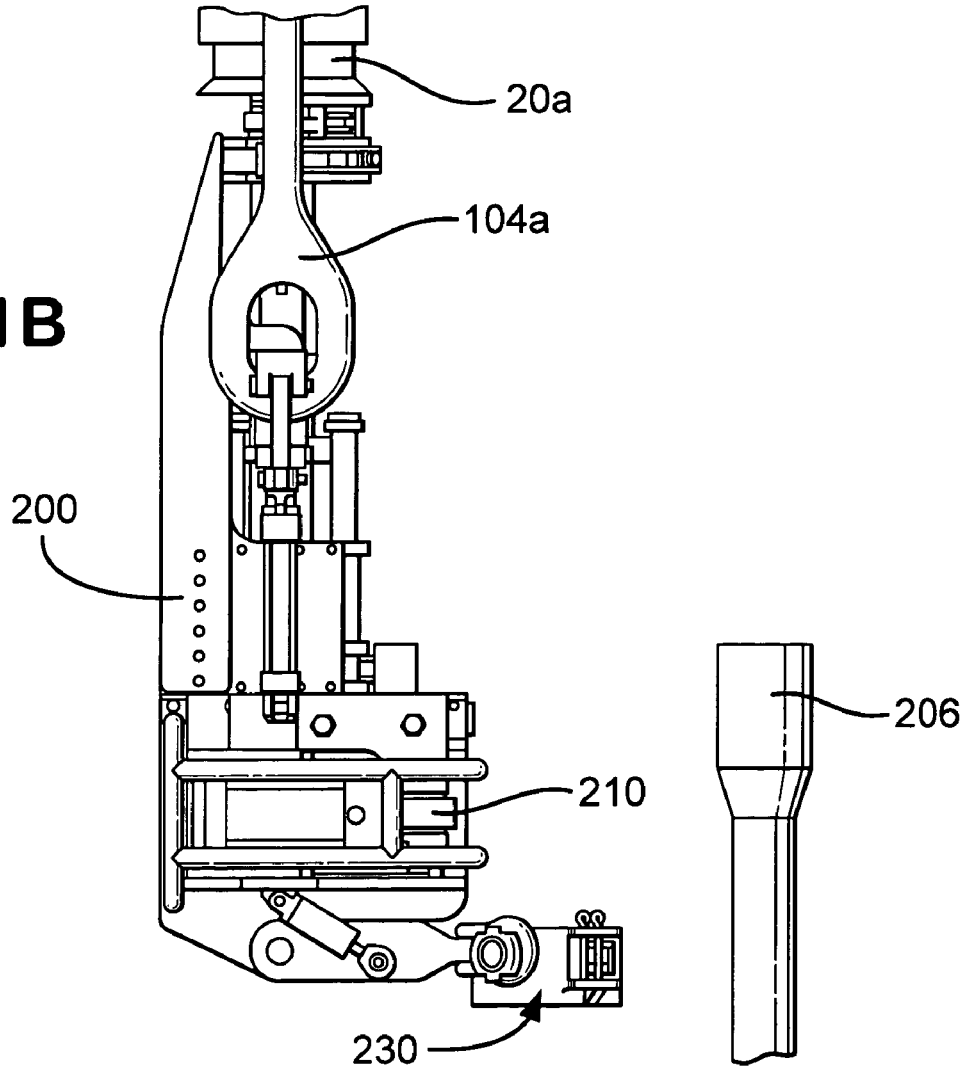
Figure 22A:
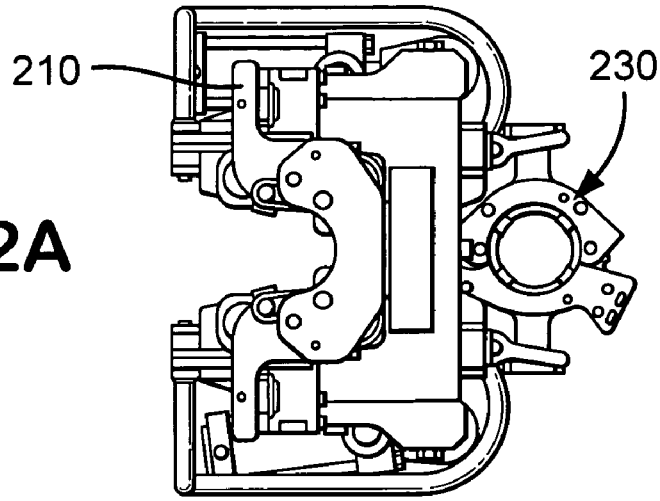
Figure 22B:
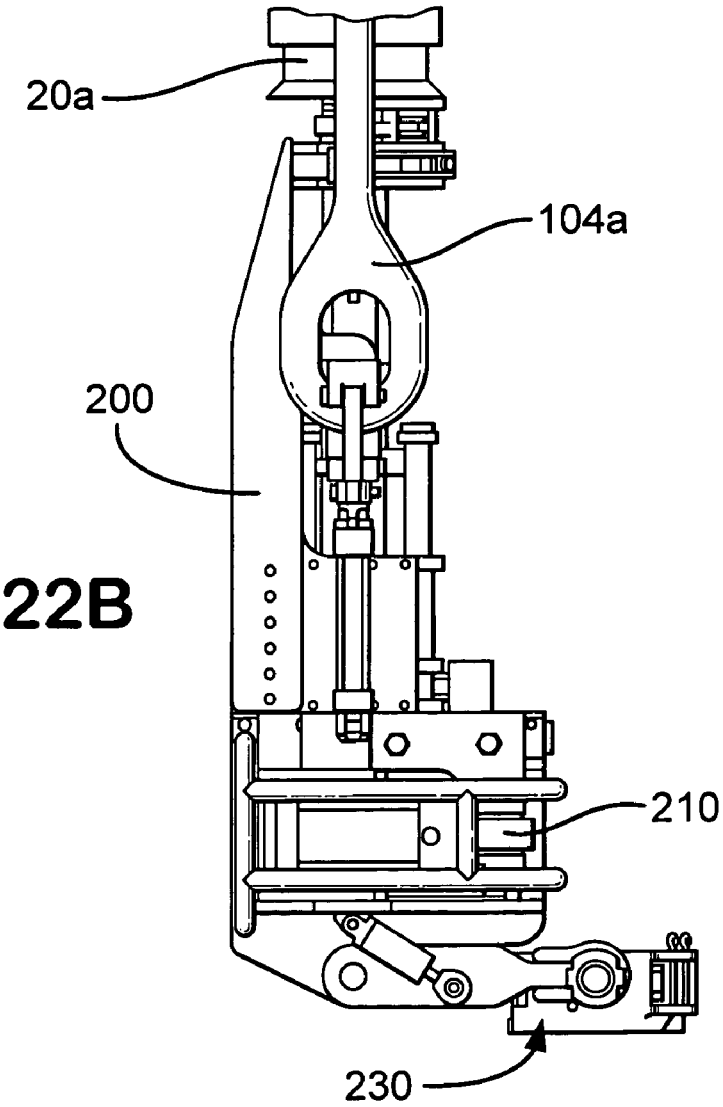

As shown in FIGS. 21A, 21B, the front end 233 of the elevator 230 is opened by the derrickman who pulls the drill pipe 206 out of the elevator 230 for racking back in a fingerboard of the derrick. As shown in FIGS. 22A, 22B, the elevator 230 is closed.

FIGS. 23A-24E illustrate a pipe guide system 300 according to the present invention which can be used with systems according to the present invention, e.g. systems as in FIG. 7B, e.g. as the pipe guide 242.

Figure 23A:
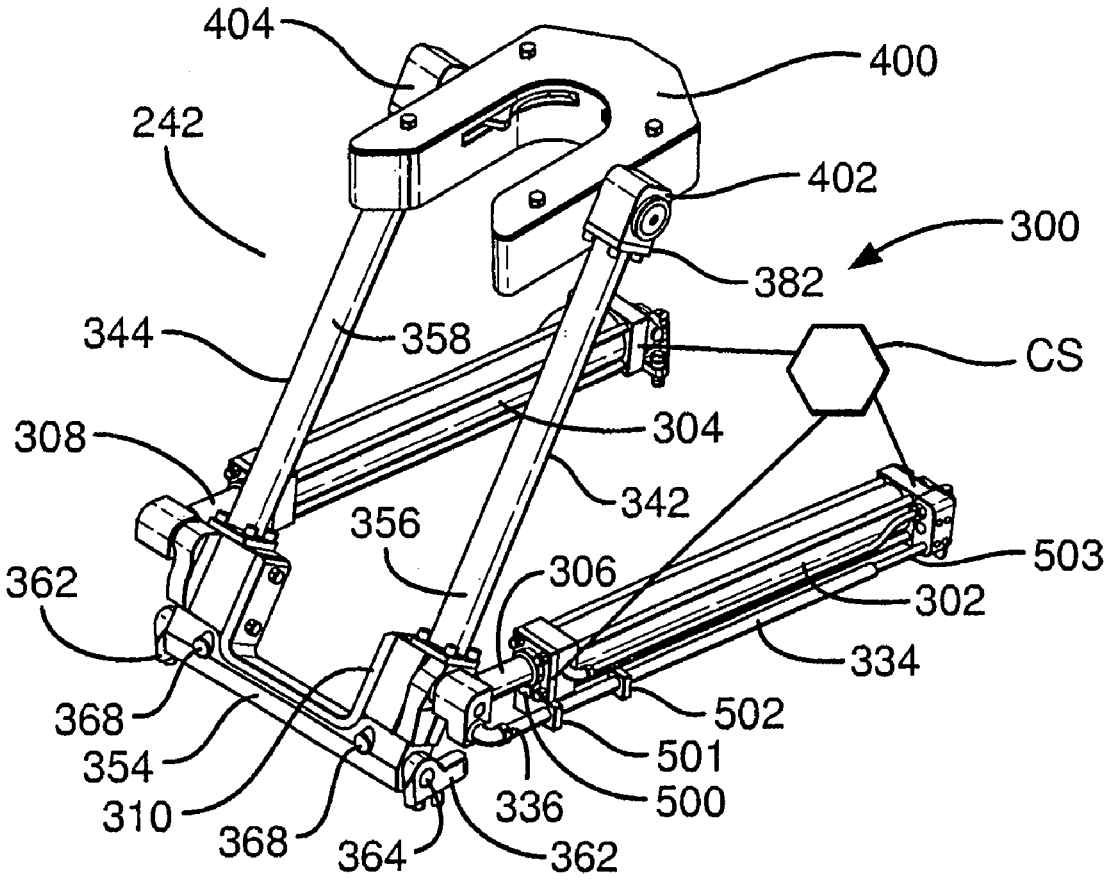
FIG. 23A is a perspective view of a pipe guide according to the present invention.
Figure 23B:
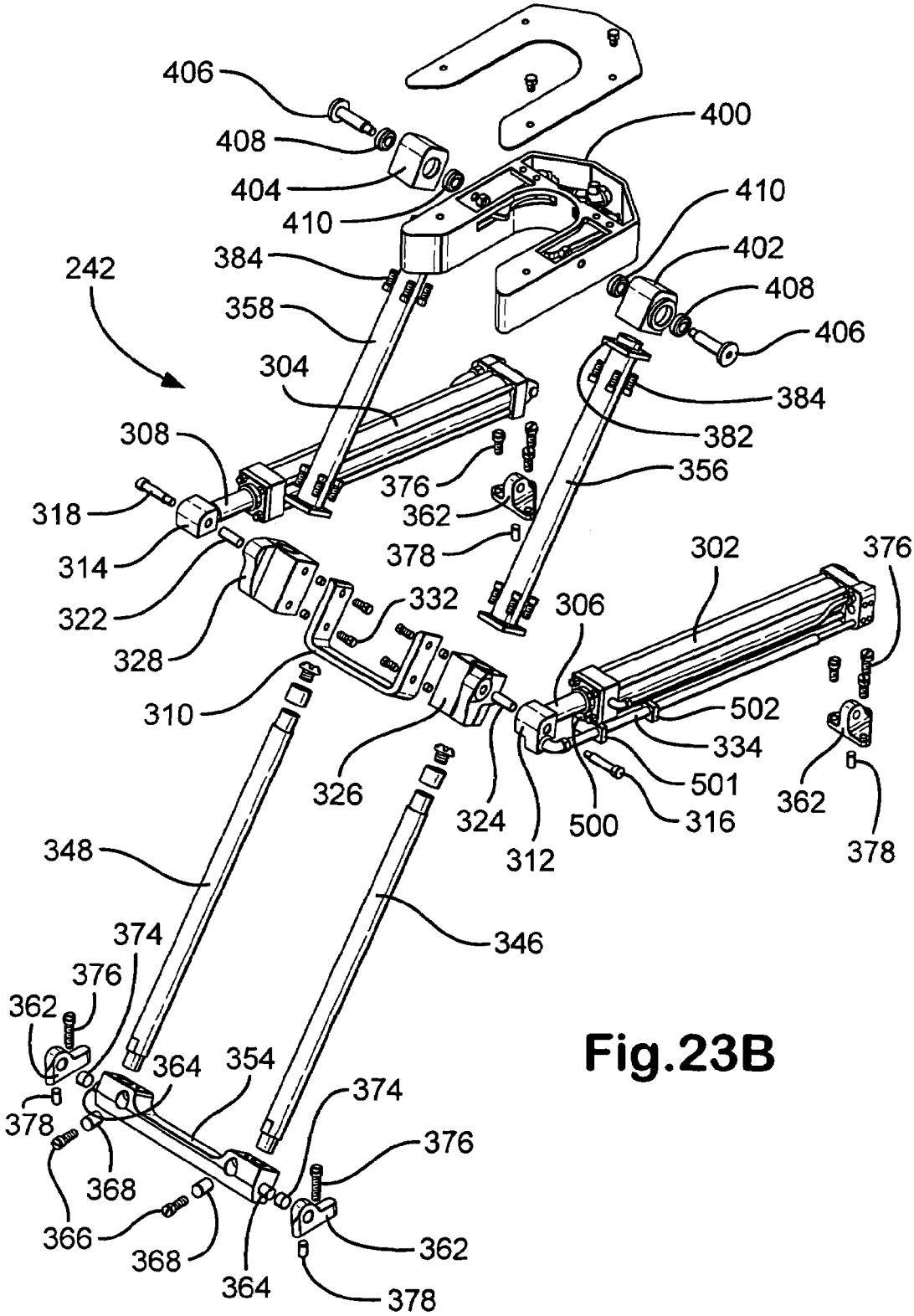
FIG. 23B is an exploded view of the pipe guide of FIG. 23A.

As shown in FIGS. 23A and 23B the pipe guide system 242 has two spaced-apart lower power cylinders 302, 204 with shafts 306, 308 that move with respect to the cylinders 302, 304, respectively. Mounts 312, 314 connected to the shafts 306, 308 are pivotably connected with screws 316, 318 with bearings 322, 324 to bases 326, 328. Screws 332 secure the bases 326, 328 to a bracket 310.

Upper slider mechanisms 342, 344 have shafts 346, 348 in tubes 356, 358 that move in a generally non-horizontal direction. Lower ends of the shafts 346, 348 are connected with screws 372 to a housing 354. The bracket 310 is secured to the bases 326, 328 with bolts 332. The housing 354 is mountable to another apparatus (e.g. a CCS unit or iron roughneck) with mounting brackets 362 through which extend shafts 364 of the housing 354 for pivotable movement of the housing 354 with respect to the brackets 362. Bearings 374 facilitate movement of the shafts 364 in the brackets 362. Mechanical stops 368 which prevent the base 310 and structure connected thereto from moving below horizontal, are secured to the housing 354 by screws 366. Screws 376 secure the brackets 362 to another apparatus or structure. Shear pins 378 take side loads and prevent side loads on bolts 376 which bolt the brackets 362 to another apparatus.

In order to stop movement of the pipe guide 242 at certain predetermined locations, e.g. at well center to stab a pipe into a CCS or at a point spaced-apart from a well center at which pipe is handed off to a pipe handler apparatus, a proximity switch 500 on the cylinder 302 is positioned so that it can sense pre-positioned target members 501, 502 on a tube 334. A rod 503 connected to the cylinder 302 moves in the tube 334 which is secured to the mount 312. In the embodiment shown in FIGS. 23A and 23B, the target member 501 is positioned at a point at which the gripper assembly 400 (with a pipe therein) is at well center. The target member 502 is positioned at a point at which the gripper assembly 400 is at a pipe pick-up/set-down area. A nut 336 can serve as a target to indicate that the gripper assembly 400 is in a stored (flat) position. The proximity switch 500 communicates and is controlled by a control system CS for the pipe guide which controls the hydraulic cylinders.

Figure 23C:
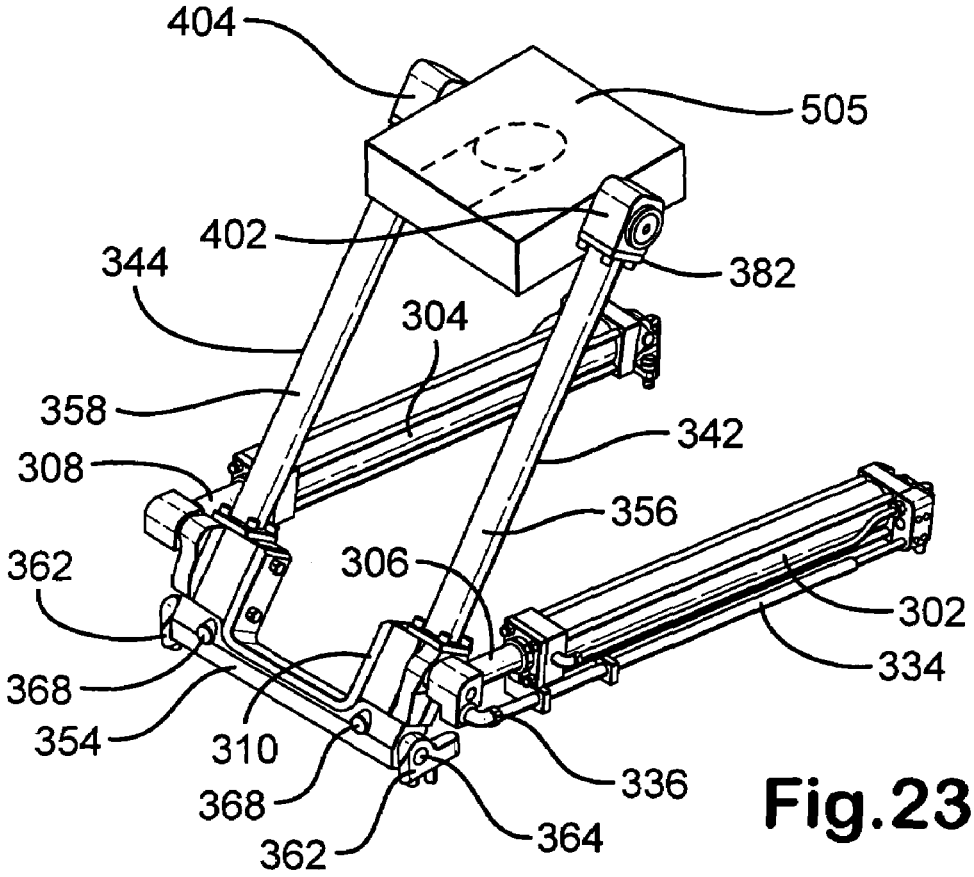
FIG. 23C is an exploded view of a system according to the present invention.

FIG. 23C illustrates that a mounting/supporting structure as in FIG. 23A may be used to support an item 505 shown schematically in FIG. 23C which may be any tubular holder, tubular receiver, tong (central opening, open throat—see dotted lines—or closed), gripper, or grabber.

The holder 244, in one aspect, is a gripper assembly 400 pivotabaly mounted with heads 402, 404 to upper ends of the tubes 356, 358. Preferably the holder 244 or gripper assembly 400 is balanced so it remains in a substantially horizontal orientation. The heads 402, 404 are secured to the tubes 356, 358 with screws 384 which extend through flanges 382 of the tubes 356, 358 into the heads 402, 404. Bolts 406 extending through bearings 408, 410 and through the heads 402, 404 to the gripper assembly 400.

The gripper assembly 400 has a housing 420 with an interior 421 and a removable top cover plate 422 secured with bolts 424 to the housing 420. Two gripping arms 432, 434 are each pivotably connected with a pin 426 extending through holes 438 to a rod 428. The rod 428 is secured with nuts 436 to the housing 420. Moving the rod 428 adjusts tension on springs 494 and allows adjustment so that ends 432*a*, 434*a* of the arms 432, 434 are within the housing 420 or projecting out from it as in FIG. 24A. To the extent of the force of the springs 494, the arms 432, 434 can hold a pipe within the housing 420.

Figure 24A:
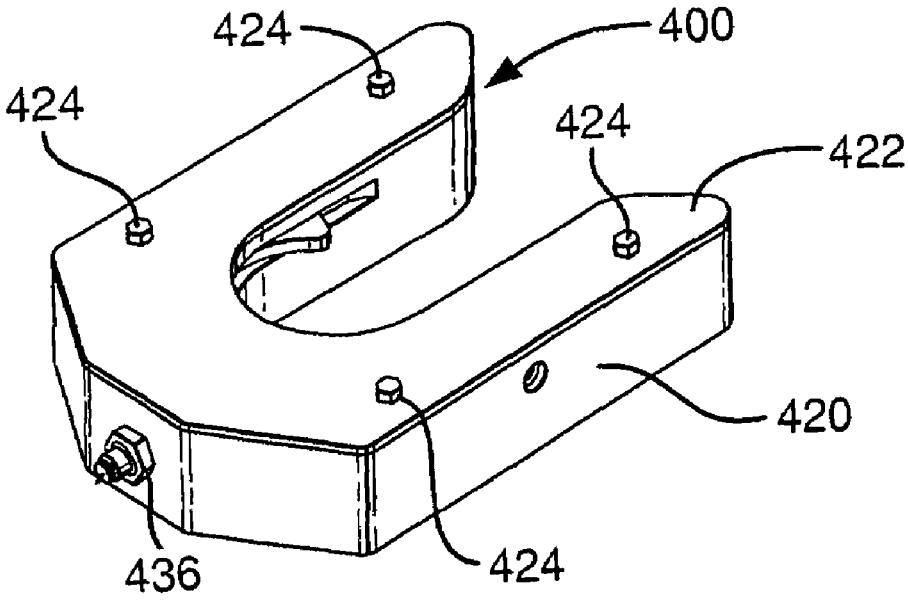
FIG. 24A is a perspective view of a gripper according to the present invention of the pipe guide of FIG. 23A.
Figure 24B:
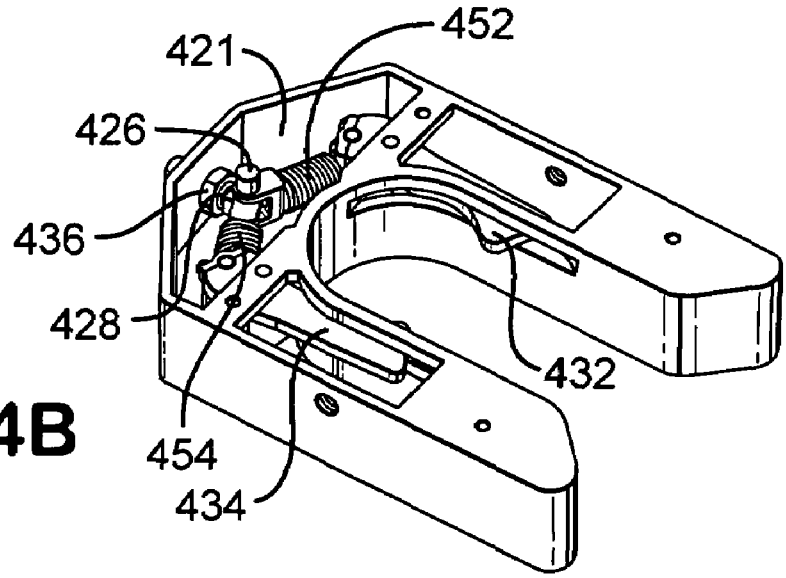
FIG. 24B is a partially cutaway perspective view of the gripper of FIG. 24A.
Figure 24C:
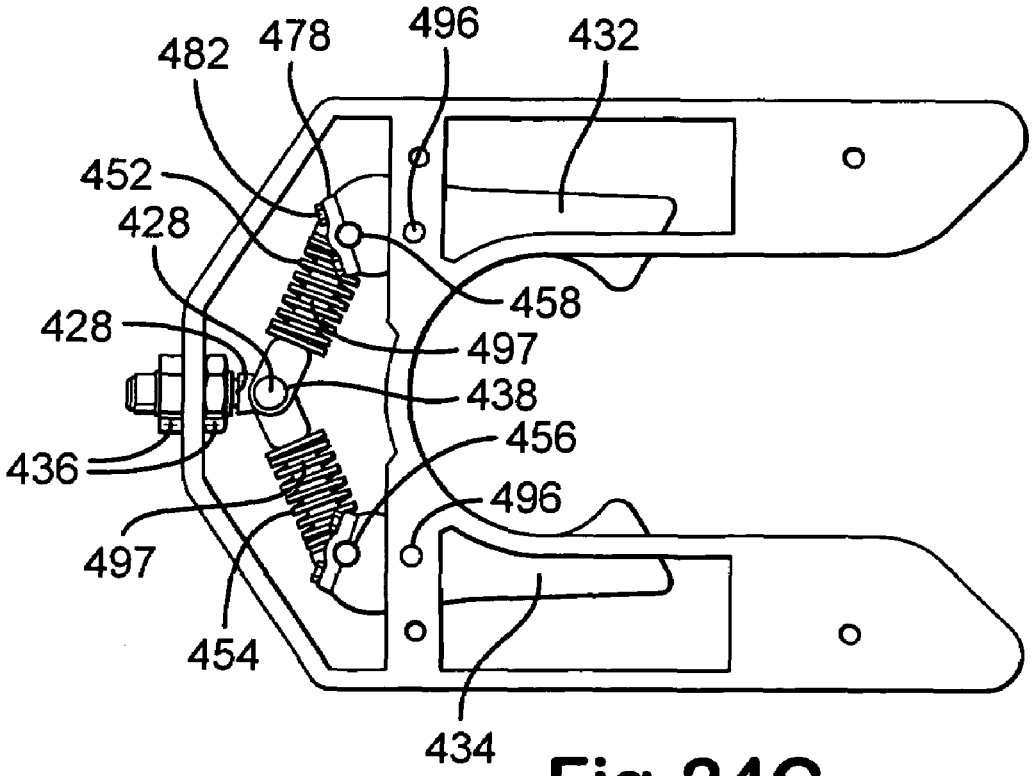
FIG. 24C is a top view of the gripper of FIG. 24A.
Figure 24D:
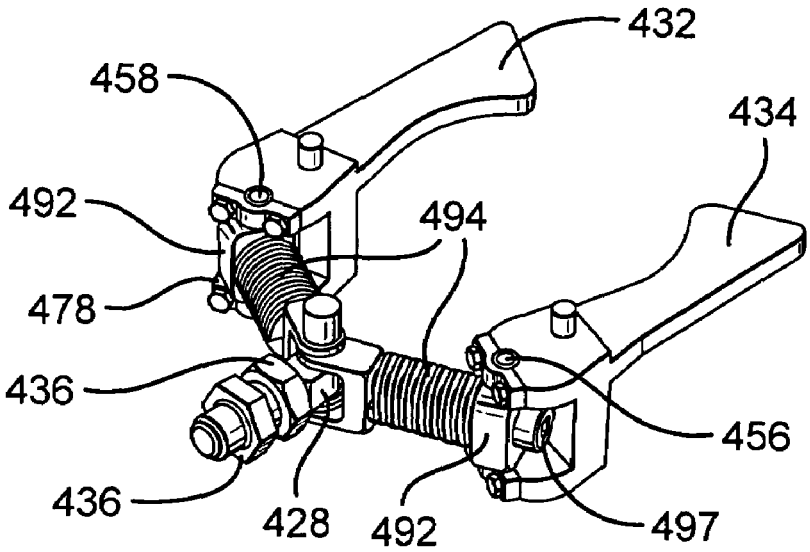
FIG. 24D is a partial perspective view of parts of the gripper of FIG. 24A.
Figure 24E:
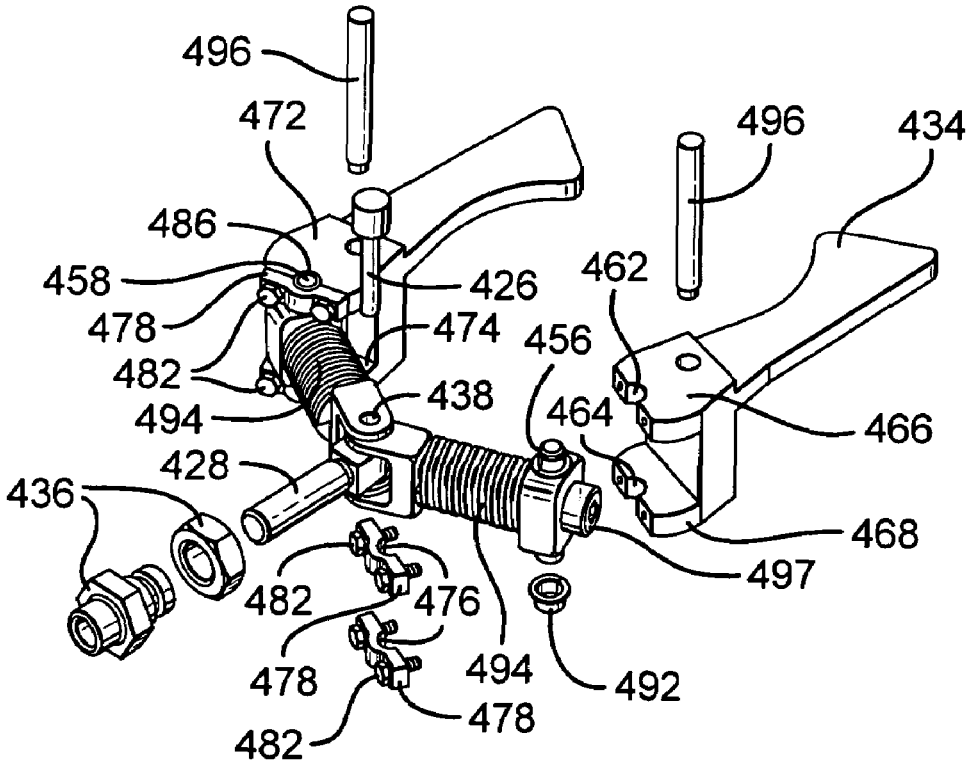
FIG. 24E is an exploded view of the parts shown in FIG. 24D.

Each arm 432, 434 is connected to a corresponding link 452, 454, respectively with pins 456, 458 which are disposed partially and captured within corresponding recesses 462, 464 in members 466, 468 (of the arm 434) and recesses 486, 488 in members 472, 474 (of the arm 432) and partially within recesses 476 of caps 478 (recess 488 not shown in FIG. 24E; located in a location corresponding to the location of the recess 468). The caps 478 are held in place with screws 482 that pass through the caps 478 and are screwed into corresponding holes 484 in the members 466, 468, 472, 474. The pins 456, 458 move on bearings 492. The springs 494 are compression springs whose force can be overcome by personnel removing a pipe from between the arms 432, 434.

The arms 432, 434 can pivot about pins 456, 458 and are also pivotable with respect to the housing 420 about pins 496 that pin the arms to the housing.

The springs 494 and connectors 492 (to which the springs 494 are connected) can both move on the shafts 497 providing a shock absorbing function.

The present invention, therefore, in at least some, but not necessarily all embodiments, provides a pipe guide with a base; upper extension apparatus pivotably secured to the base and selectively extendable from the base; lower extension apparatus having a first end and a second end, the first end pivotably secured to the upper extension apparatus, the lower extension apparatus selectively extendable with the upper extension apparatus; and pipe holder apparatus connected to the upper extension apparatus. Such a pipe guide may have one or some (in any possible combination) of the following: wherein the pipe holder apparatus is pivotably connected to the upper extension apparatus; wherein the pipe holder apparatus is balanced so that the pipe holder apparatus maintains a substantially horizontal orientation; wherein the pipe holder apparatus is from the group consisting of open throat tong, closed tong and gripper; first lower mount apparatus, and the second end of the lower extension apparatus pivotably connected to the first lower mount apparatus; second lower mount apparatus, the upper extension apparatus having a top end and a bottom end, the bottom end of the lower extension apparatus connected to the base, and the base pivotably connected to the second lower mount apparatus; wherein the pipe guide has a pipe guide center and the pipe holder apparatus is movable to and from the pipe guide center; a continuous circulation system connected to the pipe guide; first lower mount apparatus, the second end of the lower extension apparatus pivotably connected to the first lower mount apparatus, second lower mount apparatus, the upper extension apparatus having a top end and a bottom end, the bottom end of the lower extension apparatus connected to the base, the base pivotably connected to the second lower mount apparatus, the first lower mount apparatus and the second lower mount apparatus secured to a top of the continuous circulation system; wherein the continuous circulation system has a system center alignable with a well center of a wellbore and the pipe guide center is aligned with the system center; wherein the pipe guide has a pipe guide center and the pipe holder apparatus is movable to and from the pipe guide center and wherein the pipe holder apparatus is movable to a position at which the pipe holder apparatus is not above the continuous circulation system; the pipe holder apparatus has an opening for receiving a pipe; the pipe holder apparatus having movable arms for releasably holding a pipe; spring apparatus connected to the arms for urging the arms toward each other to releasably grip a pipe; adjustment apparatus connected to the arms for adjusting arm position; the adjustment apparatus adjustable to adjust tension in the spring apparatus; wherein the arms are movable to a position so that no part of the arms project into the opening; wherein the adjustment apparatus includes a first shaft mounted to a first of the arms and a second shaft mounted to a second of the arms, the spring apparatus including a spring movably mounted around each shaft, each spring acting as a shock absorber for its corresponding arm; and/or motion limit apparatus on the lower extension apparatus for selectively limiting motion of the pipe guide.

The present invention, therefore, in at least some, but not necessarily all embodiments, provides a well system with a continuous circulation system with a top and a bottom; a pipe guide connected to the top of the continuous circulation system, the pipe guide as any disclosed herein according to the present invention.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. This specification is intended to cover the invention as broadly as legally possible in whatever form it may be utilized. All patents and applications identified herein are incorporated fully herein for all purposes.

What is claimed is:

1. A pipe guide comprising a base, base extension apparatus having a first end and a second end, the first end pivotably secured to the base, the base extension apparatus selectively extendable in length from the base, holder extension apparatus selectively extendable in length and having a primary end and a secondary end, the primary end pivotably secured to the base, the second end of the base extension apparatus pivotably connected to the holder extension apparatus so that extension of the base extension apparatus pivots the holder extension apparatus with respect to the base, and pipe holder apparatus pivotably connected to the secondary end of the holder extension apparatus.

2. The pipe guide of claim 1 wherein the base has a center and the holder extension apparatus is pivotable toward and away from said center.

3. The pipe guide of claim 2 wherein the pipe holder apparatus is balanced so that the pipe holder apparatus maintains a substantially horizontal orientation.

4. The pipe guide of claim 1 wherein the pipe holder apparatus is from the group consisting of open throat tong, closed tong and gripper.

5. The pipe guide of claim 1 further comprising the base extension apparatus comprising cylinder/shaft apparatus with an extendable shaft for effecting change in overall length of the base extension apparatus.

6. The pipe guide of claim 1 further comprising the holder extension apparatus comprising cylinder/shaft apparatus with an extendable shaft for effecting change in overall length of the holder extension apparatus.

7. The pipe guide of claim 1 wherein the pipe guide has a pipe guide center and the pipe holder apparatus is movable to and from the pipe guide center by reducing overall length of the base extension apparatus.

8. The pipe guide of claim 1 further comprising a continuous circulation system connected to the pipe guide.

9. The pipe guide of claim 8 further comprising the base extension apparatus comprising cylinder/shaft apparatus with an extendable shaft for effecting change in overall length of the base extension apparatus, and the holder extension apparatus comprising cylinder/shaft apparatus with an extendable shaft for effecting change in overall length of the holder extension apparatus.

10. The pipe guide of claim 9 wherein the continuous circulation system has a system center alignable with a well center of a wellbore and the pipe holder is alignable with the system center.

11. The pipe guide of claim 10 wherein the is movable to a position not above the continuous circulation system.

12. The pipe guide of claim 1 wherein the pipe holder apparatus has an opening for receiving a pipe.

13. The pipe guide of claim 12 further comprising the pipe holder apparatus having movable arms for releasably holding a pipe, spring apparatus connected to the arms for urging the arms toward each other to releasably grip a pipe, adjustment apparatus connected to the arms for adjusting arm position, and the adjustment apparatus adjustable to adjust tension in the spring apparatus.

14. The pipe guide of claim 13 wherein the arms are movable to a position apart from the opening.

15. The pipe guide of claim 14 wherein the adjustment apparatus includes a first shaft mounted to a first of the arms and a second shaft mounted to a second of the arms, and the spring apparatus including a spring movably mounted around each shaft, each spring acting as a shock absorber for its corresponding arm.

16. The pipe guide of claim 1 further comprising motion limit apparatus on the holder extension apparatus for selectively limiting motion of the pipe guide.

17. A pipe guide comprising a base, base extension apparatus having a first end and a second end, the first end pivotably secured to the base, the base extension apparatus selectively extendable in length from the base, holder extension apparatus selectively extendable in length and having a primary end and a secondary end, the primary end pivotably secured to the base, the second end of the base extension apparatus pivotably connected to the holder extension apparatus so that extension of the base extension apparatus pivots the holder extension apparatus with respect to the base, pipe holder apparatus pivotably connected to the secondary end of the holder extension apparatus, wherein the base has a center and the holder extension apparatus is pivotable toward and away from said center, and wherein the pipe guide has a pipe guide center and the pipe holder apparatus is movable to and from the pipe guide center by reducing overall length of the base extension apparatus.

18. A well system comprising a continuous circulation system with a top and a bottom, a pipe guide connected to the top of the continuous circulation system, the pipe guide comprising a base, base extension apparatus having a first end and a second end, the first end pivotably secured to the base, the base extension apparatus selectively extendable in length from the base, holder extension apparatus selectively extendable in length and having a primary end and a secondary end, the primary end pivotably secured to the base, the second end of the base extension apparatus pivotably connected to the holder extension apparatus so that extension of the base extension apparatus pivots the holder extension apparatus with respect to the base, pipe holder apparatus pivotably connected to the secondary end of the holder extension apparatus, and the pipe holder apparatus movable toward and away from a center of the continuous circulation system.

19. The well system of claim 18 wherein the pipe guide has a pipe guide center and the pipe holder apparatus is movable to and from the pipe guide center by reducing overall length of the base extension apparatus.

20. The well system of claim 18 wherein the continuous circulation system has a system center alignable with a well center of a wellbore and the pipe holder is alignable with the system center.

* * * * *